US007798317B2

(12) United States Patent
Justice et al.

(10) Patent No.: US 7,798,317 B2
(45) Date of Patent: Sep. 21, 2010

(54) REAMED PAPER SHIPPING AND DISPLAY CONTAINER

(75) Inventors: Timothy J. Justice, Williston, TN (US); Wayne H. Kuhn, Palos Park, IL (US); Charles T. Strominger, Stillman Valley, IL (US); Ronald F. Schmitz, Mt. Washington, KY (US)

(73) Assignee: International Paper Company, Memphis, TN (US)

( * ) Notice: Subject to any disclaimer, the term of this patent is extended or adjusted under 35 U.S.C. 154(b) by 366 days.

(21) Appl. No.: 11/445,446

(22) Filed: Jun. 1, 2006

(65) Prior Publication Data

US 2006/0272961 A1 Dec. 7, 2006

Related U.S. Application Data

(60) Provisional application No. 60/772,468, filed on Feb. 10, 2006, provisional application No. 60/698,156, filed on Jul. 11, 2005, provisional application No. 60/686,211, filed on Jun. 1, 2005.

(51) Int. Cl.
*B65D 85/00* (2006.01)

(52) U.S. Cl. ..... 206/215; 206/499; 229/210

(58) Field of Classification Search ..... 206/215, 206/499; 229/210
See application file for complete search history.

(56) References Cited

U.S. PATENT DOCUMENTS

| | | | |
|---|---|---|---|
| 715,127 | A | 12/1902 | Norton |
| 1,216,071 | A | 2/1917 | Carstensen |
| 1,271,542 | A | 7/1918 | Grenshaw |
| 1,707,969 | A | 4/1929 | Paulson |
| 2,180,691 | A | 11/1939 | Olivier |
| 2,667,297 | A | 1/1954 | McReary |
| 2,721,022 | A | 10/1955 | Billerbeck |
| 2,797,039 | A | 6/1957 | Belsinger |
| 3,015,430 | A | 1/1962 | Bauer |
| 3,058,583 | A | 10/1962 | Williams |
| 3,146,936 | A | 9/1964 | Hodapp |
| 3,206,096 | A | 9/1965 | Struble |
| 3,235,167 | A | 2/1966 | Svensson |
| 3,237,842 | A | 3/1966 | Esse |
| 3,326,369 | A | 6/1967 | Tolaas |
| 3,372,856 | A | 3/1968 | Erhart |
| 3,410,476 | A | 11/1968 | Buttery |

(Continued)

FOREIGN PATENT DOCUMENTS

| | | |
|---|---|---|
| CH | 660345 | 4/1987 |

(Continued)

*Primary Examiner*—Mickey Yu
*Assistant Examiner*—Jenine M Pagan
(74) *Attorney, Agent, or Firm*—Daniel C. Stelter; Matthew M. Eslami

(57) ABSTRACT

According to one aspect of the present invention, a container is provided for shipping a plurality of items, such as pre-wrapped reams of cut-sized paper, more particularly, a container for shipping items is provided, comprising: a base portion sized to receive a plurality of items therein; a lid portion sized to fit over the base portion, thereby enclosing the plurality of items therein; wherein at least a portion of either the base portion or the lid portion includes a break-away section for at least partially opening the container to permit removal of at least one of the plurality of items therefrom.

14 Claims, 28 Drawing Sheets

U.S. PATENT DOCUMENTS 3,441,193 A 4/1969 Castle
3,603,501 A 9/1971 Confer
3,638,853 A 2/1972 Perry
3,712,531 A 1/1973 McCall
3,797,728 A 3/1974 Buttery et al.
3,831,834 A 8/1974 Elward
3,858,720 A 1/1975 Flagler
3,863,834 A 2/1975 Sandford
4,000,849 A 1/1977 Wagner et al.
4,361,236 A 11/1982 Lavery
4,512,477 A 4/1985 Densen
4,583,679 A 4/1986 Johnson
4,753,348 A 6/1988 Patrick et al.
4,778,057 A * 10/1988 Allen et al. ..... 229/120.011
4,834,242 A 5/1989 Selack et al.
4,844,262 A 7/1989 Patrick et al.
4,858,414 A 8/1989 Meschi
4,871,067 A 10/1989 Valenti
4,925,019 A 5/1990 Ganz et al.
4,951,824 A 8/1990 Kuchenbecker et al.
4,964,511 A 10/1990 Meschi
5,036,982 A 8/1991 Aston
5,176,313 A 1/1993 Curry et al.
5,259,631 A 11/1993 Brande
5,325,989 A 7/1994 Karalus
5,348,147 A 9/1994 Gottfreid
5,413,273 A 5/1995 Money
5,487,506 A 1/1996 Drummond et al.
5,505,372 A * 4/1996 Edson et al. ..... 229/121
5,622,309 A * 4/1997 Matsuda et al. ..... 229/243
5,657,872 A * 8/1997 Leftwich et al. ..... 206/738
5,738,274 A * 4/1998 Stude ..... 229/301
5,794,770 A 8/1998 Plomgren et al.
5,813,597 A 9/1998 Wakevainen
5,890,650 A * 4/1999 Penson ..... 229/243
5,988,370 A 11/1999 Roemer et al.
6,227,444 B1 5/2001 Makoesky
6,352,157 B1 3/2002 Srinivasan
6,422,454 B1 7/2002 Barr
6,578,736 B2 6/2003 Spivey
6,715,639 B2 4/2004 Spivey
6,789,673 B2 9/2004 Lingamfelte
6,923,365 B2 * 8/2005 Auclair et al. ..... 229/120.011
6,964,520 B1 11/2005 Sakai et al.
7,140,493 B2 11/2006 Fry
7,367,490 B2 * 5/2008 Forthaus et al. ..... 229/117.24
2003/0226783 A1 * 12/2003 Jackson et al. ..... 206/772

FOREIGN PATENT DOCUMENTS

DE 19918991 11/2000
EP 0235852 3/1991
EP 0844188 B1 5/1998
EP 1170221 1/2002
EP 1170221 6/2004
FR 1.227.491 8/1960
GB 1545469 5/1979
WO WO 2006/060703 6/2006

* cited by examiner

REAMED PAPER SHIPPING AND DISPLAY CONTAINER

CROSS REFERENCE TO RELATED APPLICATIONS

This application claims priority to U.S. provisional patent application Ser. No. 60/772,468, filed on 10 Feb. 2006, to U.S. provisional patent application Ser. No. 60/698,156, filed on 11 Jul. 2005, and to U.S. provisional patent application Ser. No. 60/686,211, filed on 1 Jun. 2005, all of which are hereby incorporated hereinto by reference as if fully restated herein.

BACKGROUND OF THE INVENTION

1. Technical Field of the Invention

The present invention relates to containers for shipping, storing and displaying a plurality of items such as pre-wrapped reams of cut-sized paper. More particularly, the present invention relates to a container for shipping, storing and displaying a plurality of items such as pre-wrapped reams of cut-sized paper, wherein the container is adapted to remain sealed securely during shipping yet may be opened easily for point-of-sale display and purchase. According to one aspect of the present invention, and in addition to the foregoing features of a container according to one embodiment of the present invention, a container according to the present invention is sized to hold a limited number of wrapped reams of paper and has a carry handle for convenience in handling the container.

2. Brief Description of the Related Art

Cut-sized paper, such as conventional photocopy paper, typically is wrapped in reams containing, for example, 500 sheets. It is common for a plurality of reams to be bundled together and shipped in a corrugated container. For example, it is common for two stacks of five reams of paper to be placed in a side-by-side relationship within a conventional corrugated container base having high sidewalls. To keep the reams from falling out of the container base during shipping, it is known to place a lid over the container base, and to secure the lid to the base. Several containers are then stacked on top of one another during shipping. It is desirable therefore to provide a container suitable for shipping a plurality of items, wherein the container is stackable for easy shipping, handling, storing and display.

It is common practice for the stacks of reamed paper to stand taller than the container base sidewalls, and as a result, the lid actually rests upon the top of the stacks rather than on the upper ends of the container sidewalls. Because it is common for several containers to be stacked on top of one another during shipping, reams of paper packed in stacked containers as just described typically compress as air that was trapped between the individual sheets within the reams (during the wrapping process) is "squeezed" out. It is not uncommon, then, for the containers to be compressed as the stacks of reamed paper compress. That is, as the individual reams compress, it is not uncommon for the containers to become "less tall" by virtue of the fact that the container lid (which rests upon the top of the paper stacks) moves closer towards the container base. For this reason, paper suppliers prefer not to secure the lids directly to the container bases using an adhesive because the shear strength of typical hot melt adhesives cannot withstand the shear strain resulting from movement of the lid relative to the container base. In such situations, the lids become disassociated from the container bases, thereby permitting the reams of paper to spill out of the container. Free lids also become entangled in automated material handling equipment, thereby causing machine shut downs and shipping inefficiencies. It is desirable therefore to provide a container suitable for shipping a plurality of items, wherein the container is adapted to remain sealed during typical shipping, handling and storing operations.

For this reason, it has become common to utilize ancillary securing devices, such as straps and the like, rather than adhesive, to hold such container lids onto their respective bases. However, such devices do not always prevent the lids from becoming disassociated from the bases. For example, as the containers are compressed (for the reasons described above), the straps are loosened and are free to slip off of the container either partially or entirely, allowing the lids to become disassociated from the bases, resulting in product spillage and/or damage. In addition to the free lids (which may become entangled in material handling equipment), the free straps may likewise become entangled in the material handling equipment, resulting in machine shut downs and shipping inefficiencies. Operator safety is also reduced, as the free straps and free lids clutter the workspace. It is desirable therefore to provide a container suitable for shipping a plurality of items, wherein the container is adapted to remain sealed during typical shipping, handling and storing operations without the need to utilize ancillary securing devices such as straps, and the like.

Further conventional containers holding a plurality of reams of paper may exceed 50 pounds in weight, and as such, are relatively heavy for individuals for handle. For example, typical ream-wrapped containers hold ten reams of paper. Many home computer users prefer to purchase several reams of paper at once, rather than to buy single reams more frequently, but prefer not to buy as many as ten reams at once. However, even conventional multi-ream containers that have less than ten reams are heavy, and as such, are more suitable for industrial and commercial purchasers (which typically will have material handling equipment such as power lifts and hand carts to handle such heavy reams). Average home computer users, who wish to purchase several reams of paper at once, typically do not have access to such material handling equipment. It is desirable therefore to provide a container for wrapped reams of paper, wherein the container is adapted to remain sealed during shipping, handling and storing operations without the need to utilize ancillary securing devices such as straps, and the like, and wherein the container holds fewer reams of paper (as compared to conventional multi-ream containers) and therefore is lighter in weight than conventional containers and accordingly is easier to handle. In addition, it is desirable to provide an apparatus, such as a carry handle or the like, associated with the container to facilitate even easier handling thereof. A combination of a smaller multi-ream container together with a carry handle, for example, is ideally suited for retail sales to home computer users.

SUMMARY OF THE INVENTION

According to one aspect of the present invention, a container is provided for shipping a plurality of items, such as pre-wrapped reams of cut-sized paper, more particularly, a container for shipping items is provided, comprising: a base portion sized to receive a plurality of items therein; a lid portion sized to fit over the base portion, thereby at least partially enclosing the plurality of items therein; wherein at least a portion of either the base portion or the lid portion includes a break-away section for at least partially opening the container to permit removal of at least one of the plurality of items therefrom.

According to another aspect of the present invention, a container for shipping, storing and displaying wrapped reams of paper is sized to hold a limited number of reams, thereby making it lighter in weight than conventional packages of wrapped reams of paper, and is provided with an apparatus, such as a carry handle, to facilitate handling of the container. Those of ordinary skill in the art will understand, upon reading the within description of the preferred embodiments of the present invention, that a container according to the present invention could be sized to hold any number of reams, oriented in any suitable direction, so long as the container is lighter in weight and easier to handle than conventional packages of wrapped reams of paper.

As noted previously, ream of paper normally includes about 500 sheets of paper and typically weighs about five pounds each. Conventional containers that hold ten reams of paper, therefore, weigh about 50 pounds. A container according to one aspect of the present invention preferably holds no more than six reams of paper, such that the container would weigh about 30 pounds. However, a container according to the present invention can be sized, shaped and configured to hold one, two, three, four, five, six, or any other number of, reams of paper in any orientation, such as, for example, single stack/row or multiple stacks/rows. Preferably, the weight of the container (having multiple reams therein) would not exceed 35 pounds. In the particular embodiments shown herein, a container according to various aspects of the present invention is formed from two pieces of foldable paperboard material comprising a base portion and a lid portion, and is adapted to remain sealed during typical shipping, handling and storing operations without the need to utilize ancillary securing devices such as straps or the like.

It is an object of the present invention to provide a container suitable for shipping a plurality of items, wherein the container is stackable for easy shipping, handling, storing and display.

It is another object of the present invention to provide a container suitable for shipping a plurality of items, wherein the container is adapted to remain sealed during typical shipping, handling and storing operations.

It is yet another object of the present invention to provide a container suitable for shipping a plurality of items, wherein the container is adapted to remain sealed during typical shipping, handling and storing operations without the need to utilize ancillary securing devices such as straps, and the like.

It is a still further object of the present invention to provide a reduced-sized container for shipping, storing, handling and displaying wrapped reams of paper, wherein the container is lighter in weight than conventional containers and includes a carry handle to facilitate handling of the container.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

Figure 1:
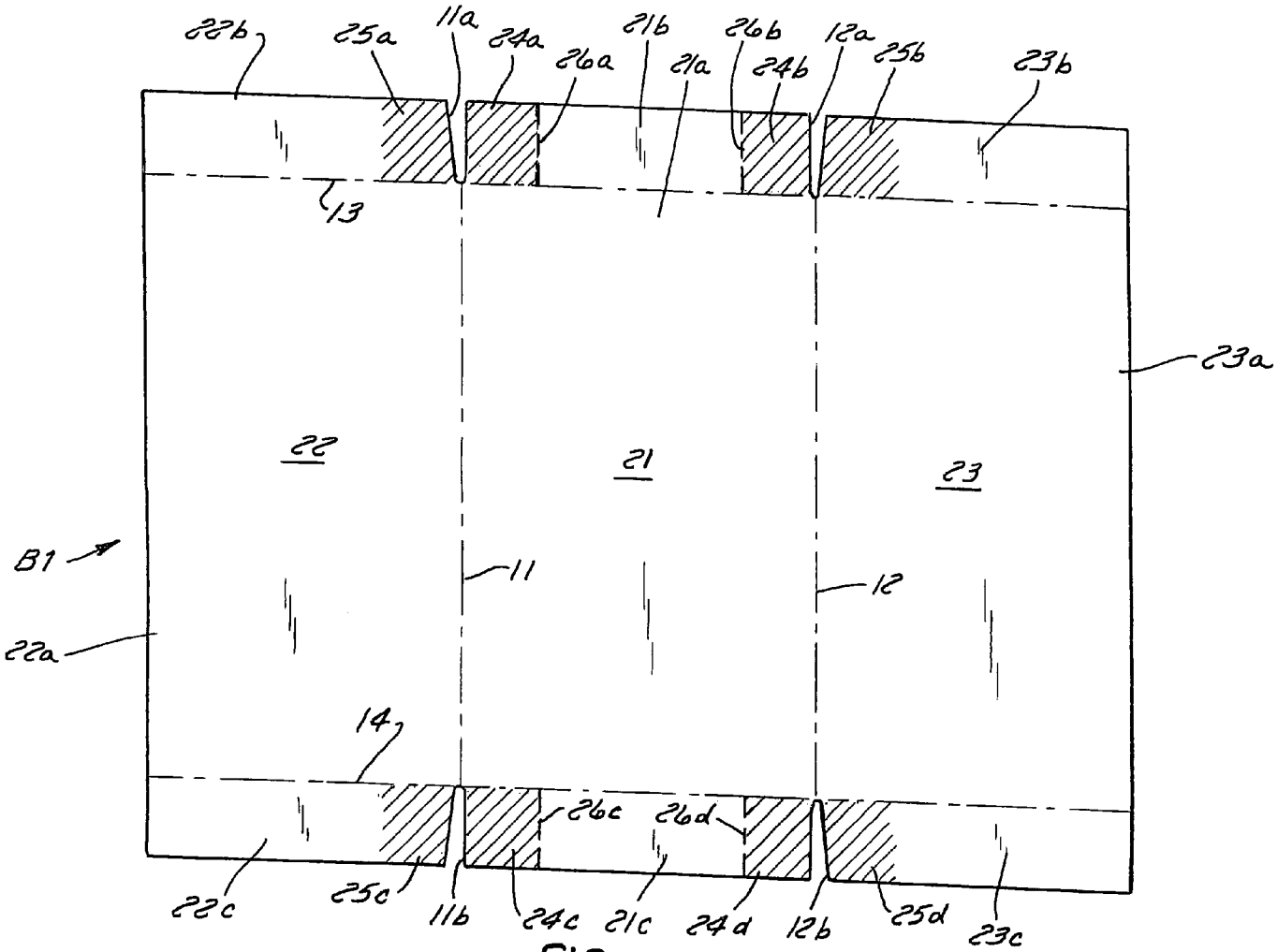
FIG. 1 is a plan view of a first blank used to form a base portion of a container according to one embodiment of the present invention.

With reference to FIG. 1, a first blank B1 is provided to form a base portion 10 (FIG. 3) of the container 1 (FIG. 3) according to one embodiment of the present invention. The first blank B1 is formed from a sheet of foldable material such as corrugated paperboard or the like and is generally rectangular in shape. First blank B1 is divided by fold lines, score lines and slits to define panels which are foldable relative to one another (as described in greater detail below) to form the base portion 10 of the container 1 according to one embodiment of the present invention.

First blank B1 is divided into a basewall panel 21 and first and second sidewall panels 22, 23 by a pair of transverse foldlines 11, 12 (shown in phantom lines), which are shown to be generally parallel to one another, although transverse foldlines 11, 12 may be oriented at some angle relative to one another. Slots 11*a*, 11*b*, 12*a*, 12*b* are cut into the first blank B1 at opposite ends of the foldlines 11, 12, respectively. Slots 11*a*, 11*b*, 12*a*, 12*b* each preferably are tapered (for reasons to be described in greater detail below), but may take on any shape that might facilitate the purposes therefor.

First blank B1 further includes a pair of longitudinal foldlines 13, 14 (shown in phantom lines), which are shown to be generally parallel to one another and perpendicular to transverse foldlines 11, 12, although longitudinal foldlines 13, 14 may be oriented at some angle relative to one another or relative to transverse foldlines 11, 12.

Longitudinal foldlines 13, 14 divide basewall panel 21 into a center section 21*a* and flanking basewall flaps 21*b*, 21*c* that are foldable relative to the basewall center section 21*a* along longitudinal foldlines 13, 14, respectively. Similarly, longitudinal foldlines 13, 14 divide first and second sidewall panels 22, 23 into respective center sections 22*a*, 23*a*, first sidewall flaps 22*b*, 23*b* and second sidewall flaps 22*c*, 23*c*, all of which are foldable relative to their respective sidewall panels 22, 23 along longitudinal foldlines 13, 14, respectively.

One or both ends of each of the basewall flaps 21*b*, 21*c* may be provided with a crushed region 24*a*, 24*b*, 24*c*, 24*d* that may be formed by compressing the blank B1 such that the crushed regions 24*a*, 24*b*, 24*c*, 24*d* have a thickness that is less than the thickness of the first blank B generally. Similarly, the ends of the sidewall flaps 22*b*, 23*b*, 22*c*, 23*c* nearest their respective basewall flaps 21*b*, 21*c* may be provided with a crushed region 25*a*, 25*b*, 25*c*, 25*d* that may be formed by compressing the blank B1 such that the crushed regions 25*a*, 25*b*, 25*c*, 25*d* have a thickness that is less than the thickness of the first blank B1 generally. The purpose and function of the crushed regions 24*a*, 24*b*, 24*c*, 24*d*, 25*a*, 25*b*, 25*c*, 25*d* will be described in greater detail below.

Crushed regions 24*a*, 24*b*, 24*c*, 24*d* may be delimited by perforation, score or weakened lines 26*a*, 26*b*, 26*c*, 26*d* (shown in dashed lines) extending from each of the longitudinal foldlines 13, 14 to the outer edges of basewall flaps 21*b*, 21*c*, respectively. The purpose and function of the perforation lines 26*a*, 26*b*, 26*c*, 26*d* will be described in greater detail below.

Figure 2:
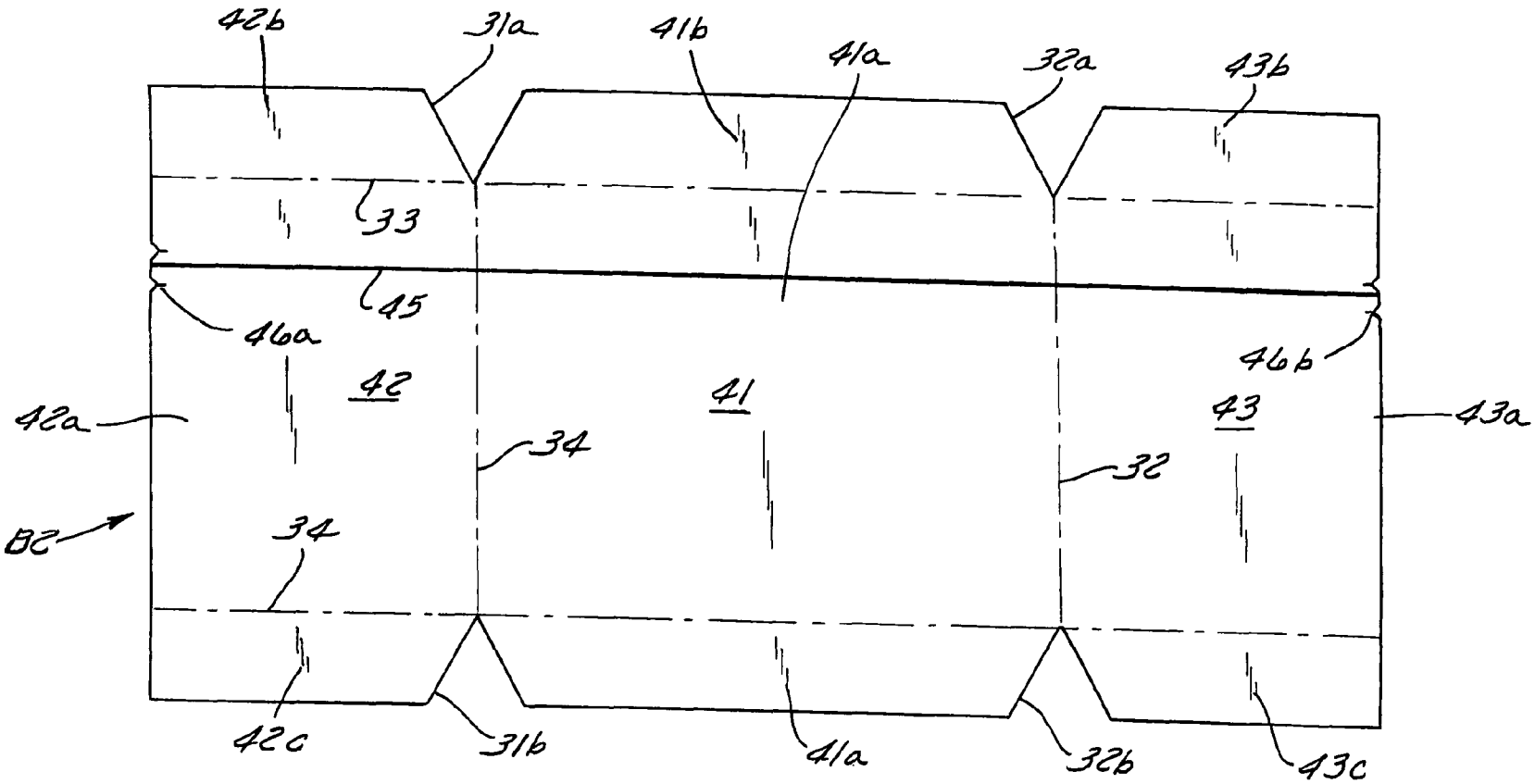
FIG. 2 is a plan view of a second blank used to form a lid portion of a container according to one embodiment of the present invention.

Referring now to FIG. 2, a second blank B2 is provided to form a lid portion 30 (FIG. 3) of the container 1 (FIG. 3) according to one embodiment of the present invention. The second blank B2 is formed from a sheet of foldable material such as corrugated paperboard or the like and is generally rectangular in shape. Second blank B2 is divided by fold lines, score lines and slits to define panels which are foldable relative to one another (as described in greater detail below) to form the lid portion 30 of the container 1 according to one embodiment of the present invention.

Second blank B2 is divided into a topwall panel 41 and first and second endwall panels 42, 43 by a pair of transverse foldlines 31, 32 (shown in phantom lines), which are shown to be generally parallel to one another, although transverse foldlines 31, 32 may be oriented at some angle relative to one another. V-shaped cutouts 31*a*, 31*b*, 32*a*, 32*b* are cut into the second blank B2 at opposite ends of the foldlines 31, 32, respectively. Cutouts 31*a*, 31*b*, 32*a*, 32*b* each preferably are tapered (for reasons to be described in greater detail below), but may take on any shape that might facilitate the purposes therefor.

Second blank B2 further includes a pair of longitudinal foldlines 33, 34 (shown in phantom lines), which are shown to be generally parallel to one another and perpendicular to transverse foldlines 31, 32, although longitudinal foldlines 33, 34 may be oriented at some angle relative to one another or relative to transverse foldlines 31, 32.

Longitudinal foldlines 33, 34 divide topwall panel 41 into a center section 41*a* and flanking topwall flaps 41*b*, 41*c* that are foldable relative to the topwall center section 41*a* along longitudinal foldlines 33, 34, respectively. Similarly, longitudinal foldlines 33, 34 divide first and second endwall panels 42, 43 into respective center sections 42*a*, 43*a*, first endwall flaps 42*b*, 43*b* and second endwall flaps 42*c*, 43*c*, all of which are foldable relative to their respective endwall panels 42, 43 along longitudinal foldlines 33, 34, respectively.

Figure 17:
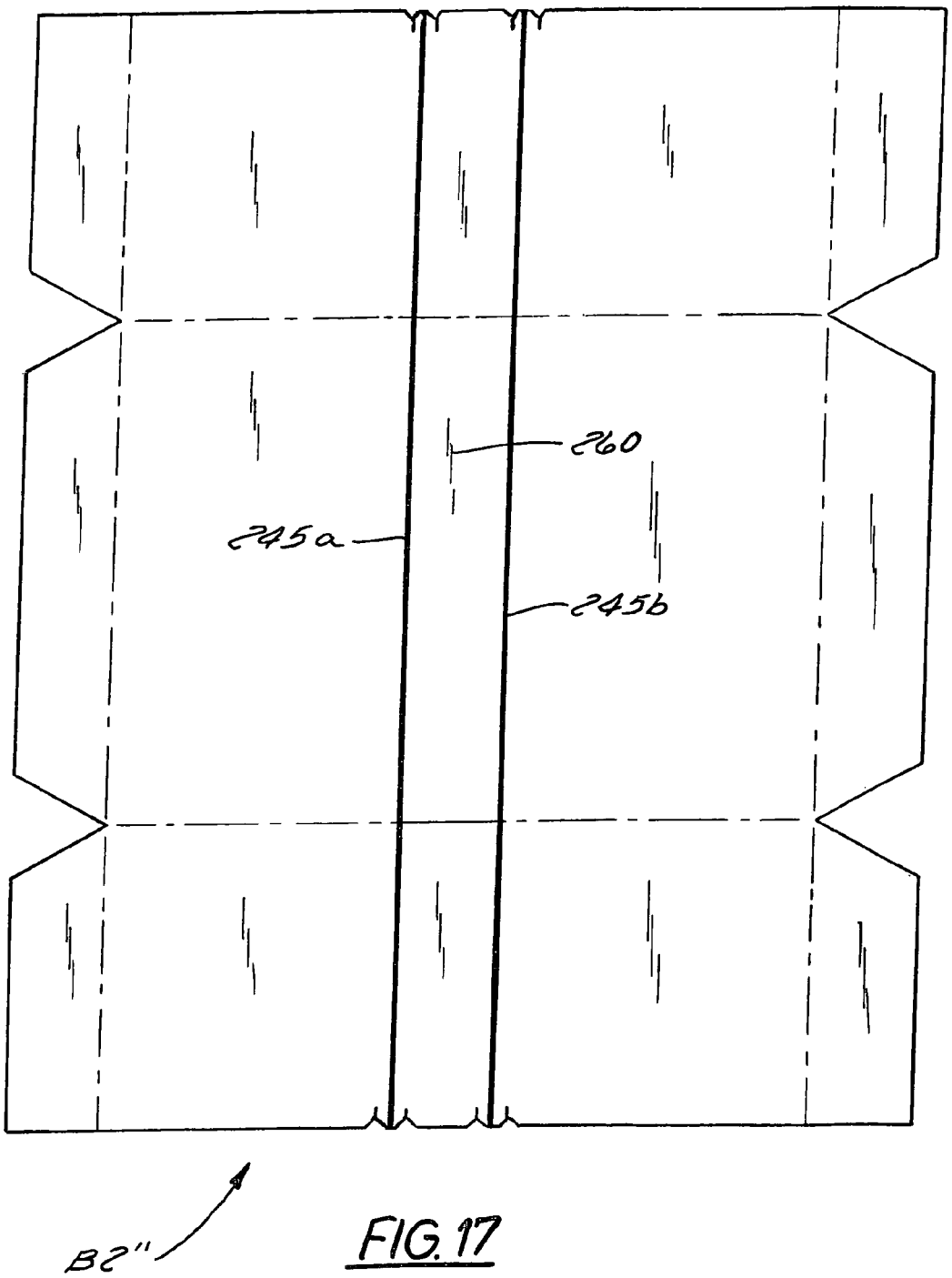
FIG. 17 is a plan view of a blank used to form a lid portion of a container according to another embodiment of the present invention.

A tearstrip 45 is embedded in the second blank B2 or affixed to one surface thereof using conventional forming and attaching techniques. Tearstrip 45 preferably extends the entire length of the second blank B2 parallel to first longitudinal foldline 33 spaced therefrom, although tearstrip 45 may extend only partially along the length of the second blank B2 and may be positioned axially at any location therealong. Pull tabs 46*a*, 46*b* may be formed in one or both of the side edges of the second blank B2 near terminal ends of the tearstrip 45 so as to permit gripping of at least one of the pull tabs 46*a*, 46*b* by a user and tearing of the tearstrip 45 utilizing conventional opening techniques. Tearstrip 45 preferably is provided nearer the first longitudinal foldline 33, although tearstrip 45 may alternatively be provided nearer the second longitudinal foldline 34. Alternatively still, two or more tearstrips may be provided and spaced from first and second foldlines (FIG. 17).

Figure 3:
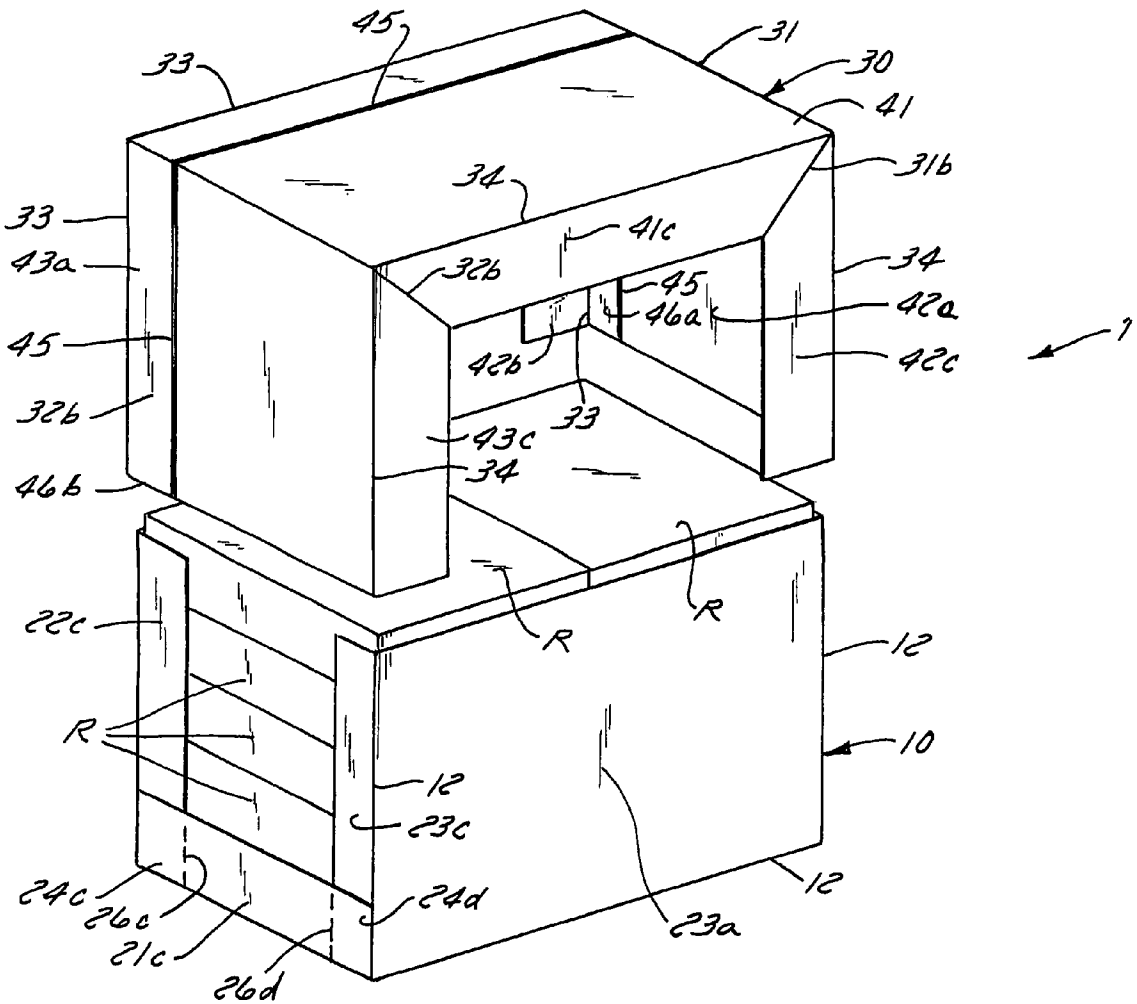
FIG. 3 is an exploded perspective view of the first blank of FIG. 1, shown folded to form a base portion of a container according to one embodiment of the present invention, and of the second blank of FIG. 2, shown folded to form a lid portion of a container according to one embodiment of the present invention, wherein the base portion is shown filled with a plurality of items, and wherein the lid portion is shown in spaced relation to the base portion.

With reference to FIG. 3, a plurality of items R, such as pre-wrapped reams of cut-sized paper are arranged in two (2) vertical stacks of five (5) reams, wherein the stacks are oriented in a side-by-side relationship. First and second blanks B1, B2 are sized such that, when folded as described herein, base portion 10 and lid portion 30 of the container 1 tightly surround and contain the stacks.

More specifically, base portion 10 is formed by first folding sidewall panels 22, 23 upward relative to the basewall 21 along transverse foldlines 11, 12, respectively, such that sidewall panels 22, 23 are generally perpendicular to the basewall 21. Thereafter, sidewall flaps 22*b*, 22*c* and sidewall flaps 23*b*, 23*c* each are folded inwardly towards one another relative to sidewall panels 22*a*, 23*a*, respectively, about longitudinal foldlines 13, 14, respectively, to form vertically-oriented base portion corners of the container 1. Basewall flaps 21*b*, 21*c*, then, are folded upwardly relative to the basewall center section 21*a* along longitudinal foldlines 13, 14, respectively, and over sidewall flaps 22*b*, 23*b* and 22*c*, 23*c*, respectively, such that crushed regions 26*a*, 26*b*, 26*c*, 26*d* lie over and are adhesively secured to crushed regions 25*a*, 25*b*, 25*c*, 25*d*, respectively. Although it is preferable to adhesively secure crushed regions, alternative means of affixing the crushed regions as described herein, such as by staples, and the like, may be employed. Because the thickness of the crushed regions 25*a*, 25*b*, 25*c*, 25, 26*a*, 26*b*, 26*c*, 26*d* is less than the general thickness of the first blank B1, the container 1 does not bulge near the crushed regions 25*a*, 25*b*, 25*c*, 25, 26*a*, 26*b*, 26*c*, 26*d*.

Lid portion 30 is formed by first folding endwall panels 42*a*, 43*a* downward relative to the topwall 41 along transverse foldlines 31, 32, respectively, such that endwall panels 42, 43 are generally perpendicular to the topwall 41. Thereafter, endwall flaps 42*b*, 42*c* and endwall flaps 43*b*, 43*c* each are folded inwardly towards one another relative to endwall panels 42*a*, 43*a*, respectively, about longitudinal foldlines 33, 34, respectively, to form vertically-oriented lid portion corners of the container 1 which lie outside base portion corners when the lid portion 30 is positioned thereover. Topwall flaps 41*b*, 41*c*, then, are folded downwardly relative to the topwall center section 41*a* along longitudinal foldlines 33, 34, respectively. V-shaped cutouts 31*a*, 31*b*, 32*a*, 32*b* permit topwall flaps 41*b*, 41*c* to lie generally in the same plane as endwall flaps 42*b*, 43*b* and endwall flaps 42*c*, 43*c*, respectively, without overlapping.

Figure 12:
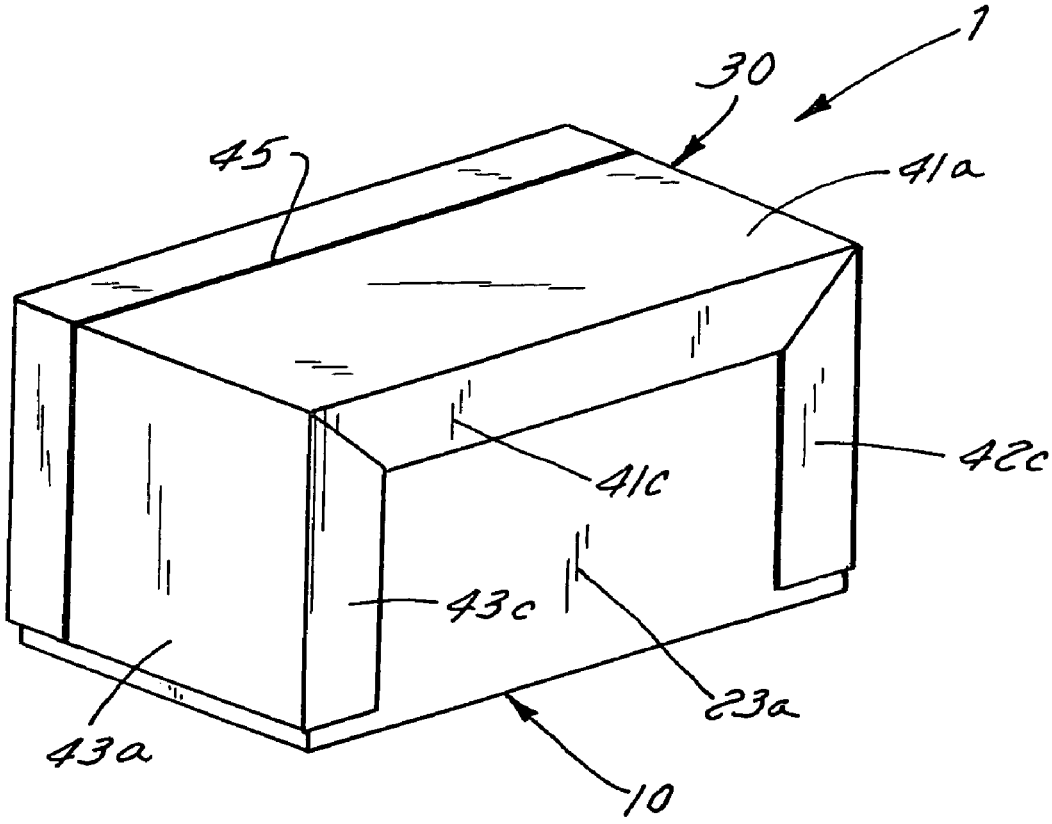
FIG. 12 is a perspective view of the second blank of FIG. 2, showing a third step used to form a lid portion of the container shown in FIG. 3, wherein lid portion endwall flaps are folded relative to lid portion endwalls and adhered to base portion sidewalls.

Lid portion 30 is telescopingly fit over the base portion 10 to define a fully-enclosed container 1 (FIG. 12). Tearstrip 45 is positioned preferably to be adjacent one or more of the perforation lines 26*a*, 26*b*, 26*c*, 26*d*, for the purpose and function described in greater detail below. Lid portion flaps 41*b*, 42*b*, 43*b* and flaps 41*c*, 42*c*, 43*c* are adhesively affixed to the sidewall panels 22*a*, 23*a*, respectively, so that the lid portion 30 is adhesively affixed to the base portion 10 with sufficient adhesive strength to prevent disassociation of the lid portion 30 from the base portion 10. Outwardly facing surfaces of the base portion flaps 21*b*, 22*b*, 23*b* and flaps 21*c*, 22*c*, 23*c* may also be adhesively affixed to inwardly facing surfaces of the lid portion endwall panels 42*a*, 43*a*, respectively, to further strengthen the adhesive bond between the lid portion 30 and the base portion 10, thereby forming a fully-enclosed container having sufficient rigidity to resist compression due to vertical stacking of several containers 1 on top of one another. It will be apparent to those of ordinary skill in the art upon reading the within disclosure that a container 1 according to one embodiment of the present invention meets each of the objectives thereof.

Figure 4:
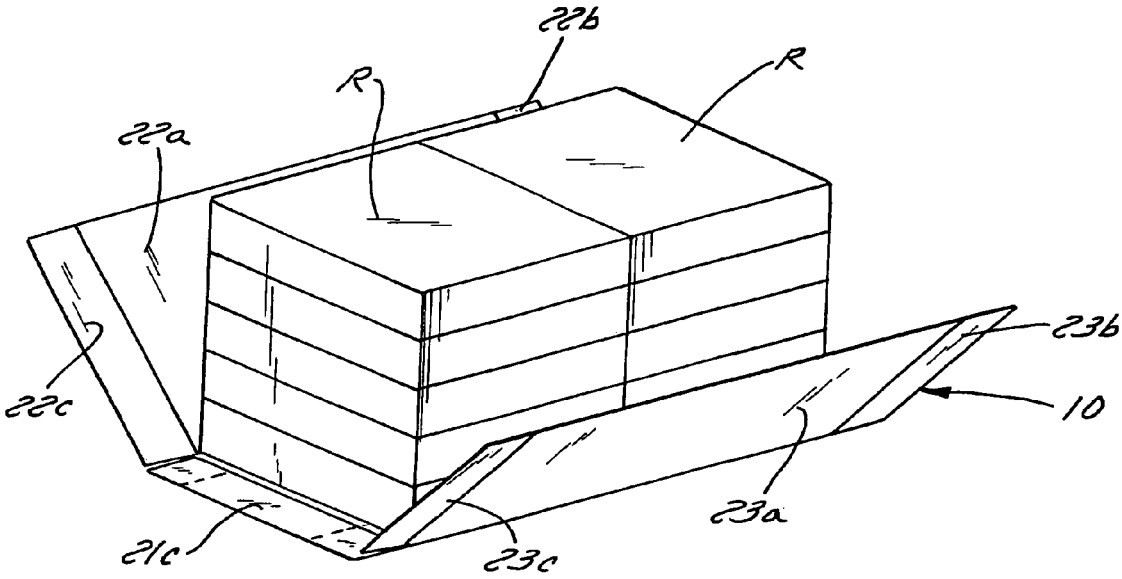
FIG. 4 is a perspective view of the first blank of FIG. 1, showing a first step used to form the base portion of the container shown in FIG. 3, wherein the first and second sidewalls of the first blank are folded relative to a basewall thereof.

FIGS. 4-12 more specifically illustrate one method of automatedly forming a container 1 according to one embodiment of the present invention for the purpose of packaging a plurality of items R stored therein. More specifically, FIG. 4 shows a first step for packaging a plurality of items R wherein the plurality of items are stacked in a side-by-side relationship above the basewall center section 21*a* of the first blank B1. It can be seen from FIG. 4 that the surface area of basewall center section 21*a* is approximately equal to the combined surface area "footprint" of the stacks of items R such that the base portion 10 of the container 1 can be formed tightly around the stacks of items R.

Figure 5:
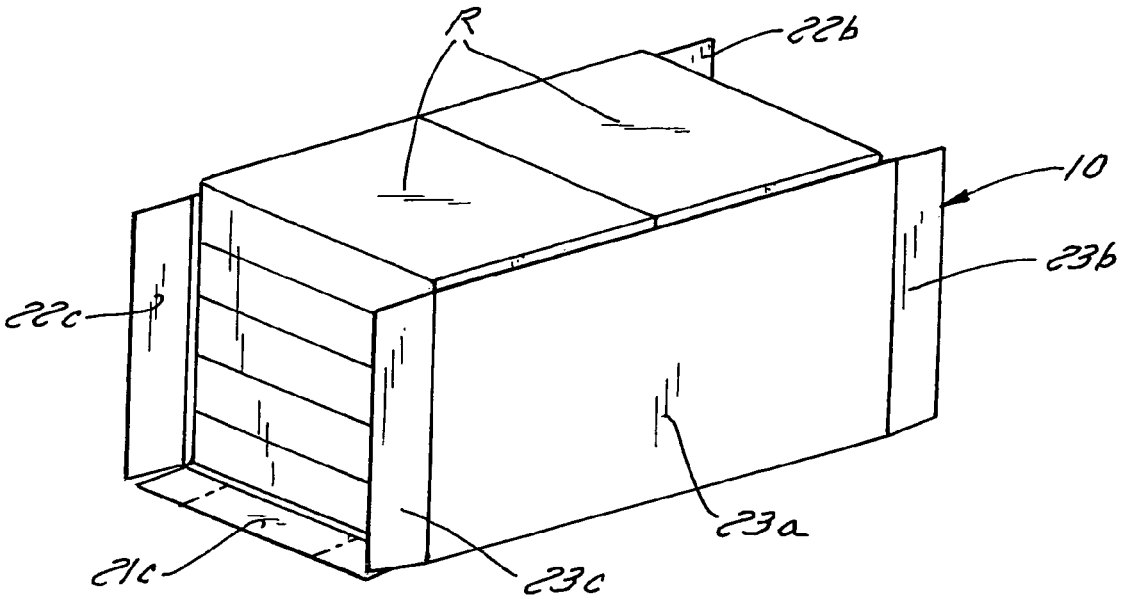
FIG. 5 is a perspective view of the first blank of FIG. 1, showing the first and second sidewalls of the first blank adjacent a plurality of items stored therein.

Once the stacks of items R are positioned over the basewall center section 21*a*, sidewall panels 22, 23 are folded upwardly to meet sidewall portions of the stacks of items R. FIG. 5 illustrates the base portion 10 being thus partially formed around the stacks of items R.

Figure 6:
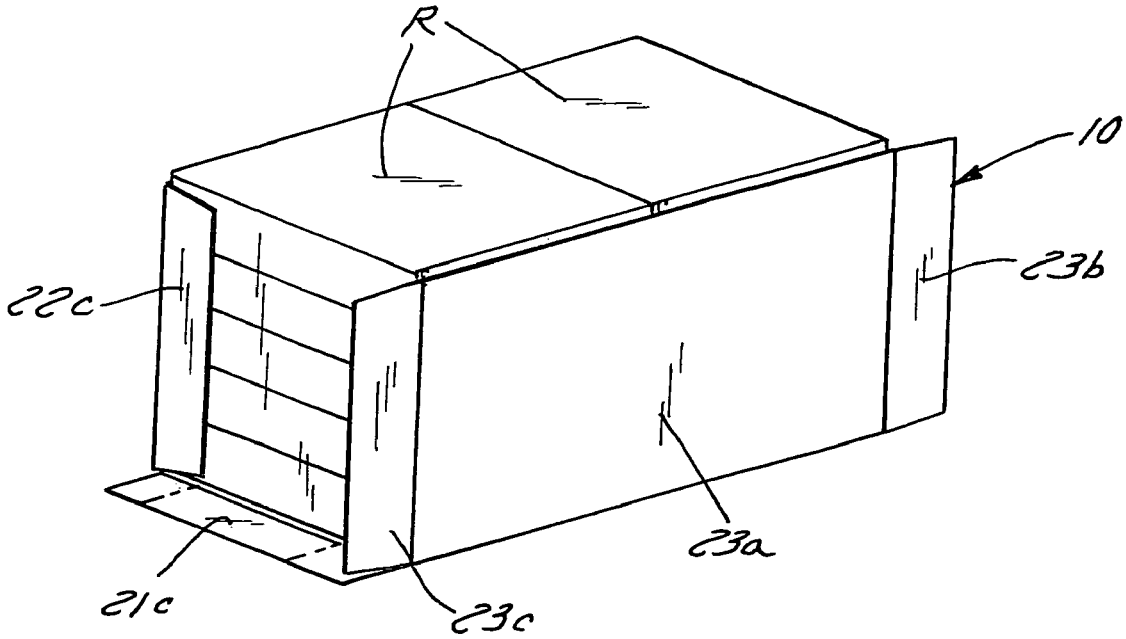
FIG. 6 is a perspective view of the first blank of FIG. 1, showing a second step used to form the base portion of the container shown in FIG. 3, wherein first sidewall flaps are folded relative to the sidewalls.
Figure 7:
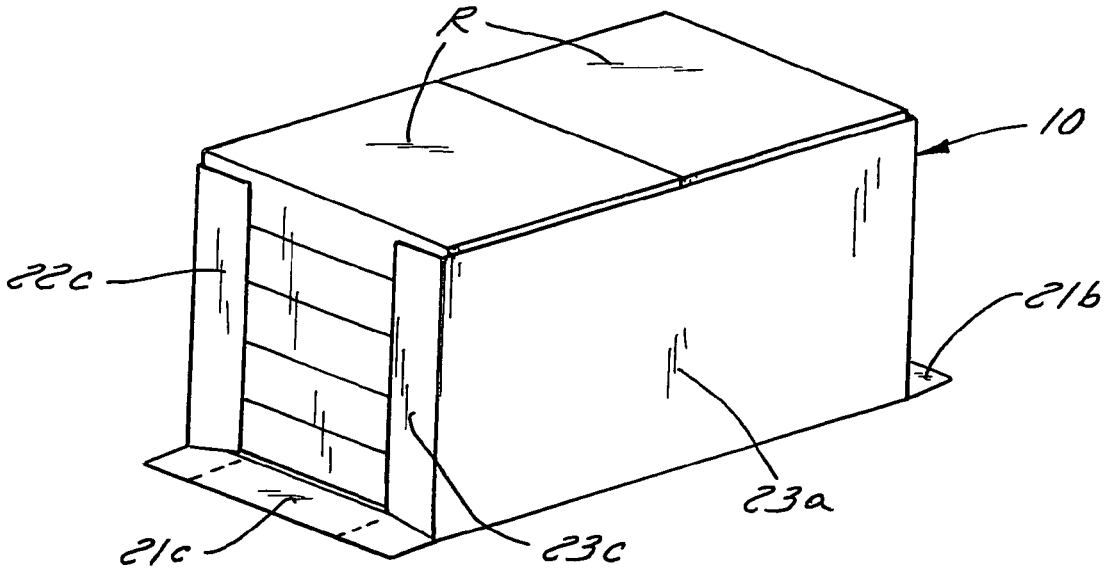
FIG. 7 is a perspective view of the first blank of FIG. 1, showing a third step used to form the base portion of the container shown in FIG. 3, wherein second sidewall flaps are folded relative to the sidewalls.
Figure 8:
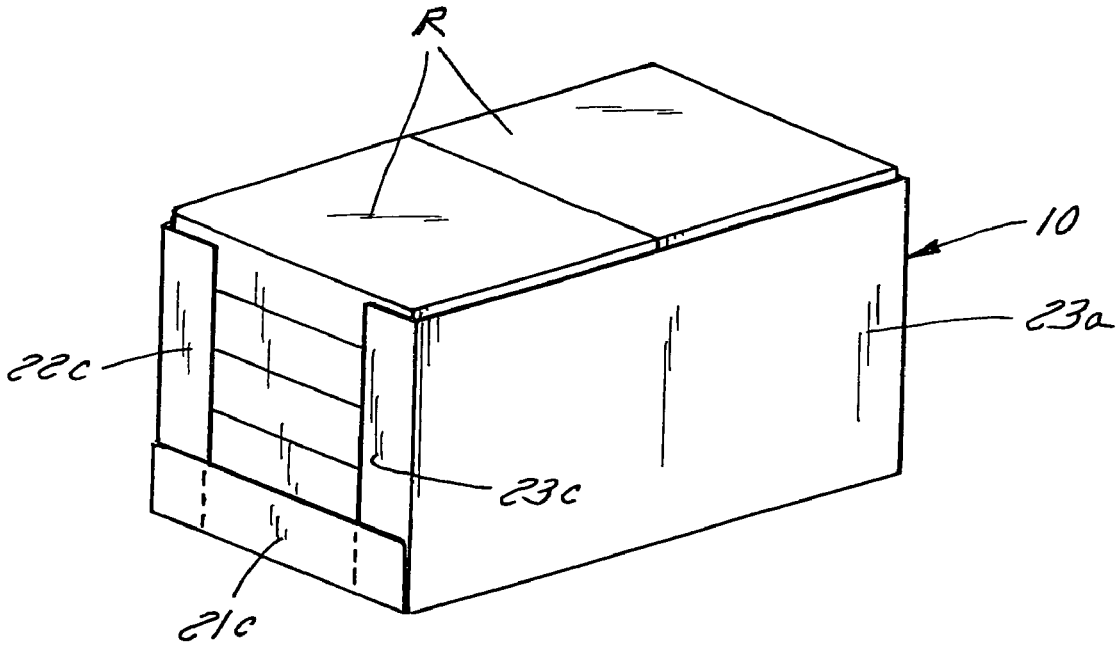
FIG. 8 is a perspective view of the first blank of FIG. 1, showing a fourth step used to form the base portion of the container shown in FIG. 3, wherein basewall flaps are folded relative to the basewall and adhered to base portion sidewalls.

With reference now to FIGS. 6-8, after sidewall panels 22, 23 are folded to face the stacks of items R, flaps 21*b*, 22*b*, 23*b* and flaps 21*c*, 22*c*, 23*c* are folded inwardly relative to their respective sidewall panels 22, 23 so as to fold "around" distal ends of the stacks of items R, thereby forming vertical corners to the bottom portion 10 of the container 1. As described above, crushed regions overlie one another and are adhesively secured to one another so as to define a self-standing, upright bottom portion 10 of the container 1.

Figure 9:
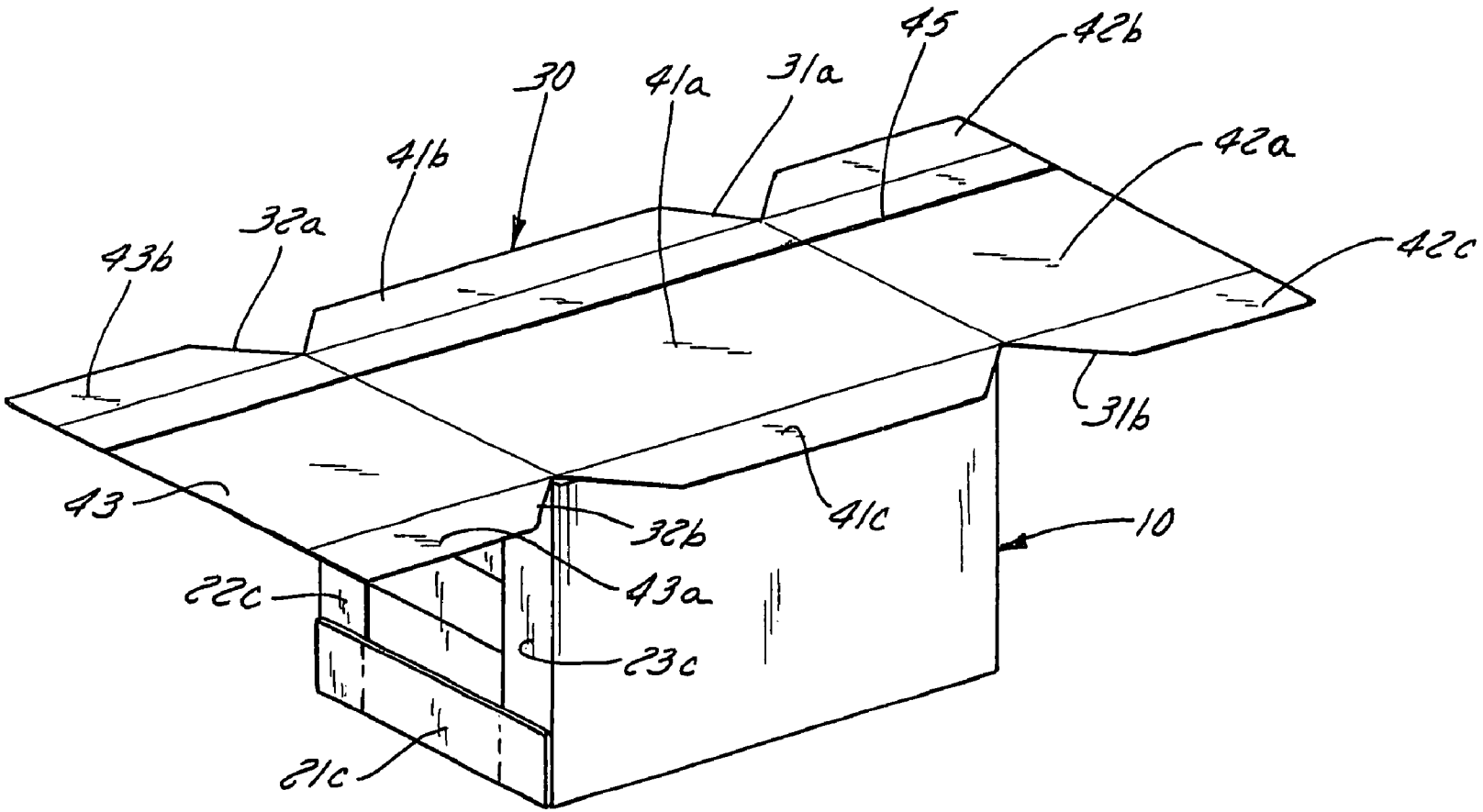
FIG. 9 is a perspective view of the second blank of FIG. 2, showing the second blank being positioned over the base portion of the container shown in FIG. 3.
Figure 10:
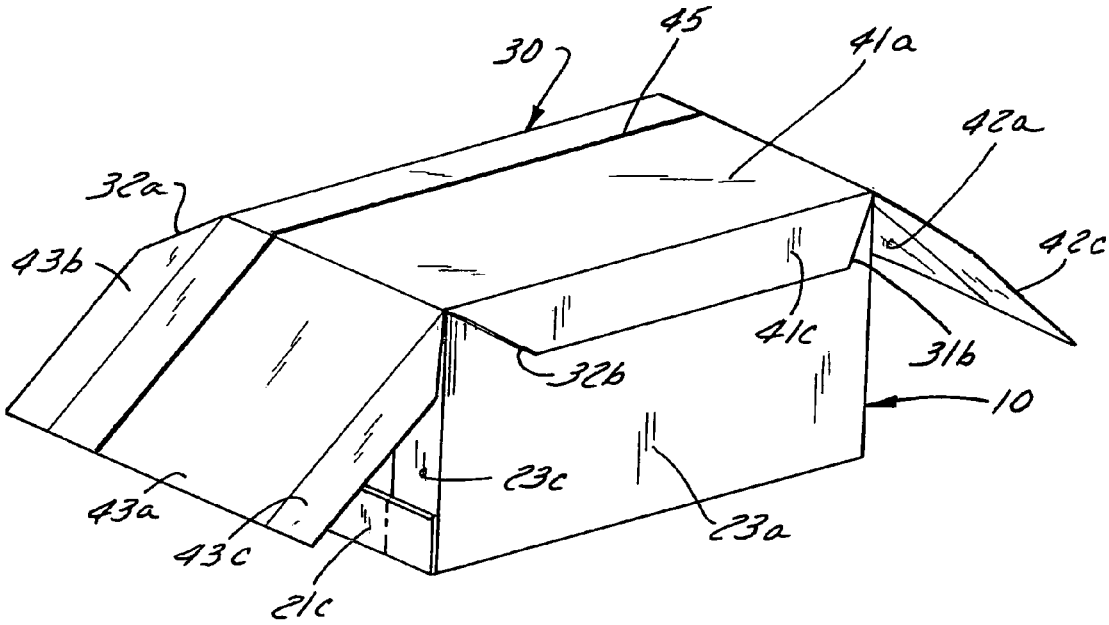
FIG. 10 is a perspective view of the second blank of FIG. 2, showing a first step used to form the lid portion of the container shown in FIG. 3, wherein first and second endwalls are folded relative to the topwall.

FIG. 9 shows a next step for forming a container 1 according to one embodiment of the present invention, wherein the topwall panel center section 41*a* of the second blank B2 is positioned over the stack of items. It can be seen from FIG. 4 that the surface area of topwall center section 41*a* is approximately equal to the combined surface area "footprint" of the stacks of items R such that the lid portion 30 of the container 1 can be formed tightly around the stacks of items R.

Figure 11:
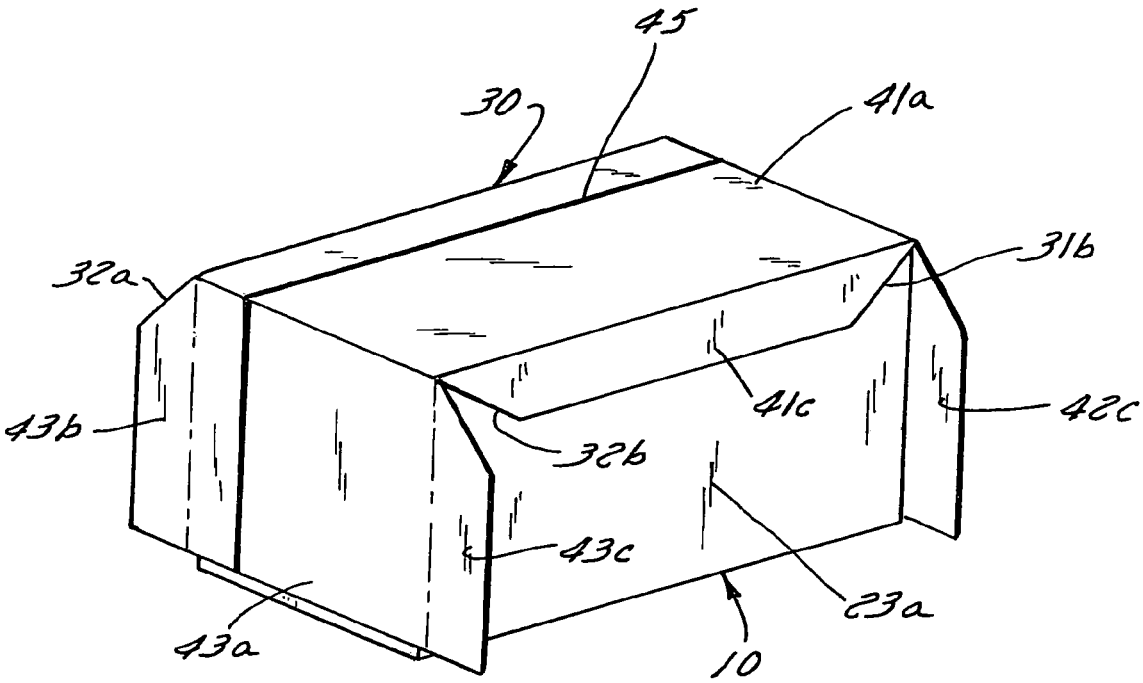
FIG. 11 is a perspective view of the second blank of FIG. 2, showing a second step used to form the lid portion of the container shown in FIG. 3, wherein lid portion endwalls are adhered to base portion sidewall flaps, and wherein lid portion sidewall flaps are folded relative to the topwall and adhered to base portion sidewalls.

Once the second blank B2 is positioned over the stacks of items R, endwall panels 42, 43 are folded downwardly to meet endwall portions of the stacks of items R. FIG. 11 illustrates the lid portion 30 being thus partially formed around the stacks of items R.

With reference now to FIG. 12, after endwall panels 42, 43 are folded to face the stacks of items R, flaps 41*b*, 42*b*, 43*b* and flaps 41*c*, 42*c*, 43*c* are folded inwardly relative to their respective endwall panels 42, 43 so as to fold "around" distal ends of the stacks of items R, thereby overlapping the vertical corners defined by the bottom portion 10 of the container 1. As described above, V-shaped cutouts 31*a*, 32*a* and 31*b*, 32*b* allow for flaps 41*a*, 42*a*, 43*a* and flaps 41*b*, 42*b*, 43*b* to meet along edges of the V-shaped cutouts 31*a*, 32*a*, 31*b*, 32*b* to meet at upper corners of the container 1 without overlapping one another. Once thus folded, flaps 41*b*, 42*b*, 43*b* and flaps 41*c*, 42*c*, 43*c* are secured (such as, by adhesive) to their respective sidewall panels 22, 23 of the bottom portion 10 of the container 1, so as to secure the lid portion 30 firmly to the bottom portion 10, thereby defining a tight enclosure for securely transporting the items R packed therein.

It should also be noted that it is preferred to apply some downward pressure to the second blank B2, as it is positioned over the stacks of items R and prior to securing the top portion 30 to the bottom portion 10 so that items R are compressed somewhat so as to prevent the creation of void space within the container 1 during shipping, such as may be created, for example, if the lid portion 30 were secured to the base portion 10 prior to the escape of any entrapped air from within the items R.

Figure 13:
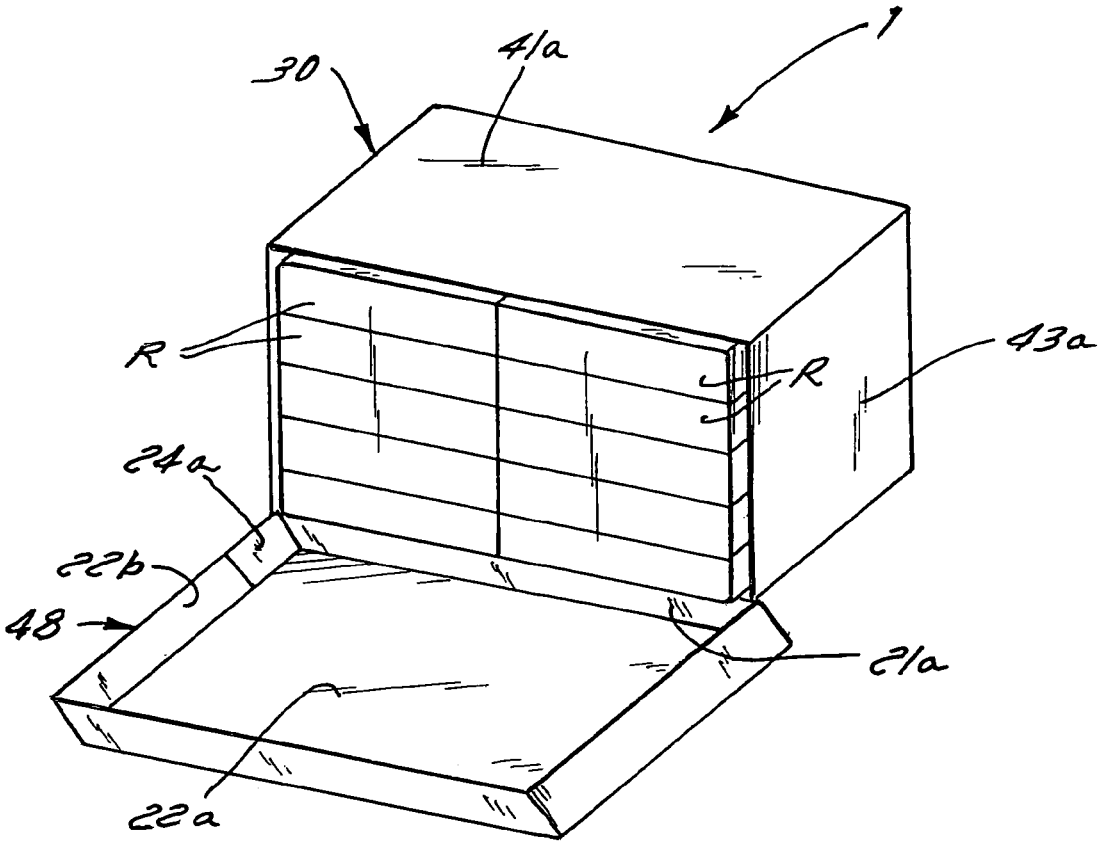
FIG. 13 is a perspective view of a container according to one embodiment of the present invention, showing one sidewall thereof being partially detached and in an open position.

Referring now to FIG. 13, the container 1 is configured to provide a shelf-ready display package, suitable for at least partially opening and placing directly on a product shelf for point-of-sale display. Specifically, tearstrip 45 is used (such as by gripping one of the pull tabs 46*a*, 46*b* and pulling same away from the container 1) to open one side of the container 1, thereby exposing the ends of the items R packaged therein. According to one embodiment of the present invention, the tearstrip 45 functions to separate a break-away section 48 of the lid 30 from the remaining portion of the container 1. Perforations 26*a*, 26*b*, 26*c*, 26*d* provided in the base portion 10, then, can be torn to allow the break-away section 48 to pivot freely relative to the basewall panel 21*a*. A scoreline (not shown) may be provided in the basewall panel 21*a*, for example, extending between perforation 26*a* and perforation 26*c*, thereby facilitating easy rotational movement of the break-away section 48 relative to the remaining portion of the container 1. Alternatively, the scoreline may be a perforation or another tear strip (not shown) which would allow a user to detach the break-away section 48 altogether from the remaining portion of the container 1.

Figure 14:
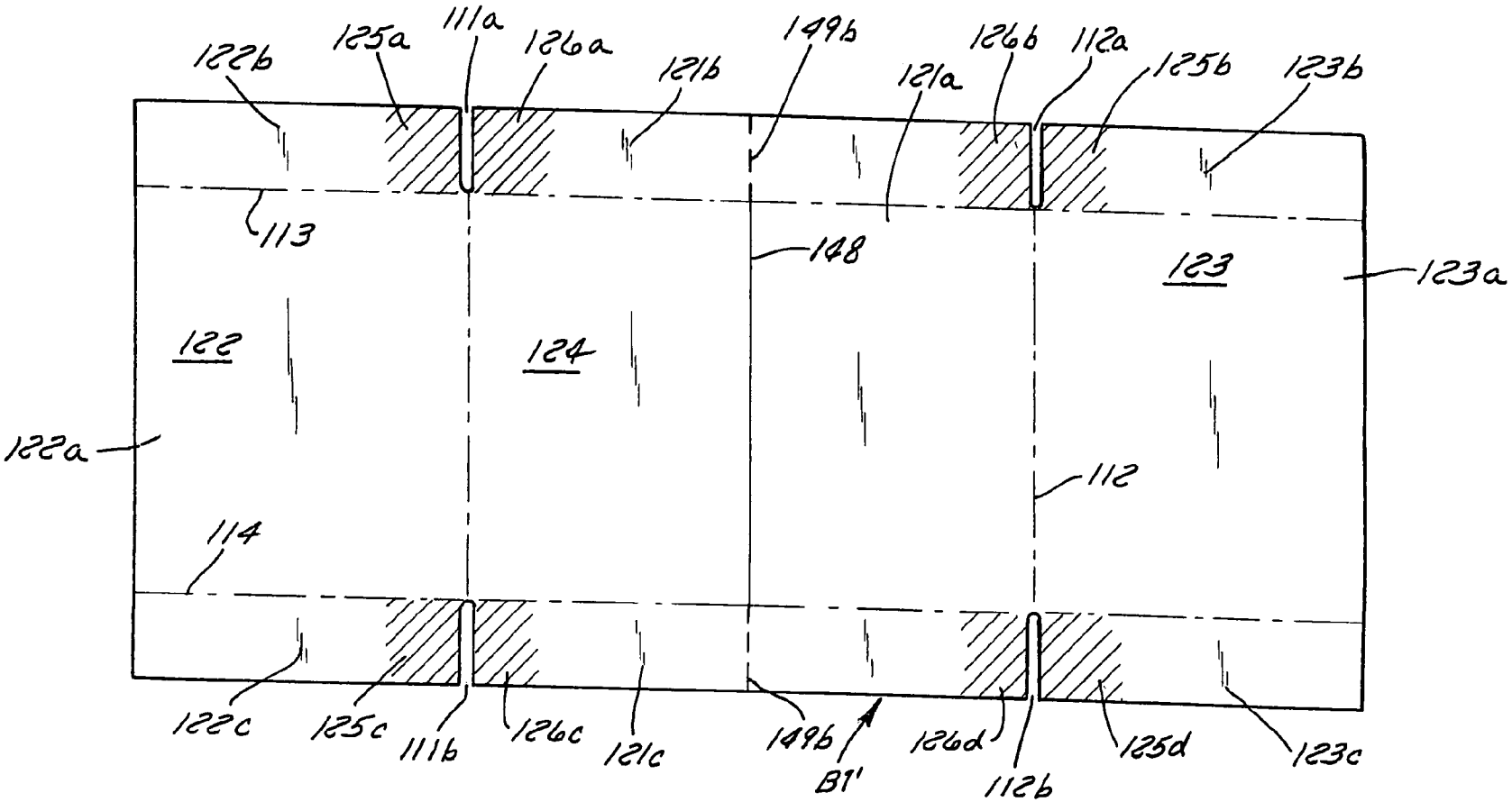
FIG. 14 is a plan view of a first blank used to form a base portion of a container according to one alternative embodiment of the present invention.

With reference now to FIG. 14, a first alternative blank B1' is provided to form a base portion 110 (FIG. 16) of the container 101 (FIG. 16) according to another embodiment of the present invention. The first alternative blank B1' is formed from a sheet of foldable material such as corrugated paperboard or the like and is generally rectangular in shape. First alternative blank B1' is divided by fold lines, score lines and slits to define panels which are foldable relative to one another (as described in greater detail herein) to form the base portion 110 of the container 101.

First alternative blank B1' is divided into a basewall panel 121 and first and second sidewall panels 122, 123 by a pair of transverse foldlines 111, 112 (shown in phantom lines), which are shown to be generally parallel to one another, although transverse foldlines 111, 112 may be oriented at some angle relative to one another. Slots 111*a*, 111*b*, 112*a*, 112*b* are cut into the first alternative blank B1' at opposite ends of the foldlines 111, 112, respectively. Slots 111*a*, 111*b*, 112*a*, 112*b* each may be tapered (although are shown in the Figure to be generally straight), but may take on any shape that might facilitate the purposes therefor.

First alternative blank B1' further includes a pair of longitudinal foldlines 113, 114 (shown in phantom lines), which are shown to be generally parallel to one another and perpendicular to transverse foldlines 111, 112, although longitudinal foldlines 113, 114 may be oriented at some angle relative to one another or relative to transverse foldlines 111, 112.

Longitudinal foldlines 113, 114 divide basewall panel 121 into a center section 121*a* and flanking basewall flaps 121*b*, 121*c* that are foldable relative to the basewall center section 121*a* along longitudinal foldlines 113, 114, respectively. Similarly, longitudinal foldlines 113, 114 divide first and second sidewall panels 122, 123 into respective center sections 122*a*, 123*a*, first sidewall flaps 122*b*, 123*b* and second sidewall flaps 122*c*, 123*c*, all of which are foldable relative to their respective sidewall panels 122, 123 along longitudinal foldlines 113, 114, respectively.

One or both ends of each of the basewall flaps 121*b*, 121*c* may be provided with a crushed region 124*a*, 124*b*, 124*c*, 124*d* that may be formed by compressing the blank B1' such that the crushed regions 124*a*, 124*b*, 124*c*, 124*d* have a thickness that is less than the thickness of the first alternative blank B1' generally. Similarly, the ends of the sidewall flaps 122*b*, 123*b*, 122*c*, 123*c* nearest their respective basewall flaps 121*b*, 121*c* may be provided with a crushed region 125*a*, 125*b*, 125*c*, 125*d* that may be formed by compressing the blank B1' such that the crushed regions 125*a*, 125*b*, 125*c*, 125*d* have a thickness that is less than the thickness of the first alternative blank B1' generally. The purpose and function of the crushed regions 124*a*, 124*b*, 124*c*, 124*d*, 125*a*, 125*b*, 125*c*, 125*d* will be obvious to one of ordinary skill in the art upon reading the within description.

The present embodiment differs from the embodiment hereof shown in FIG. 1 in that the center section 121*a* of the basewall panel 121 is provided with a scoreline 148 running generally parallel to foldlines 111, 112 and extending between foldlines 113, 114. The scoreline 148. Perforation lines 149*a*, 149*b* extend beyond the terminal ends of the scoreline 148, through first and second basewall flaps 121*b*, 121*c*, respectively. Alternatively, a plurality of scorelines (rather than perforation lines) may be provided for the purpose and function described in greater detail below.

Figure 15:
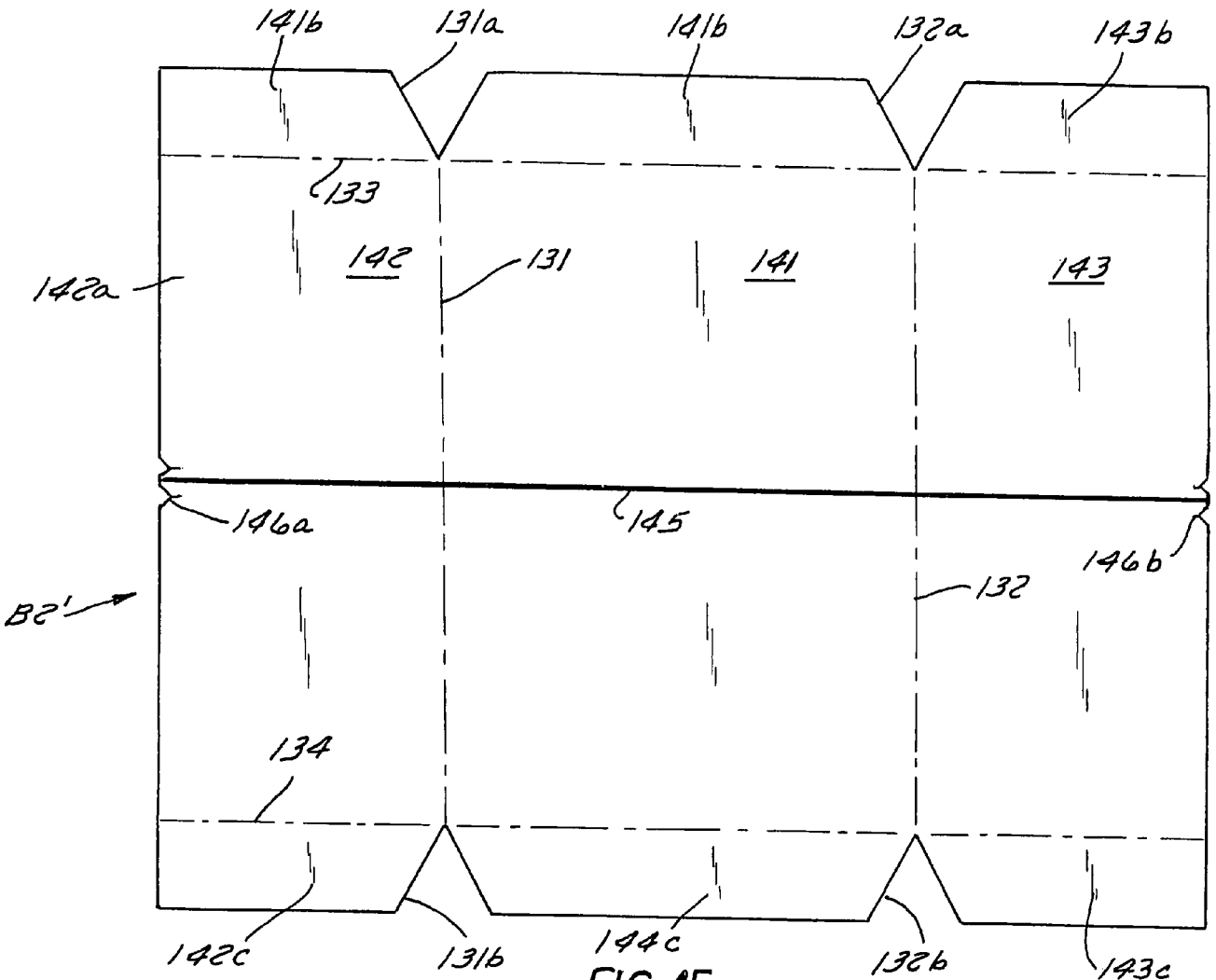
FIG. 15 is a plan view of a second blank used to form a lid portion of a container according to one alternative embodiment of the present invention.

Referring now to FIG. 15, a second alternative blank B2' is provided to form a lid portion 130 (FIG. 16) of the container 101 (FIG. 16) for use, for example, with the first alternative blank B1' shown in FIG. 14. The second alternative blank B2' is formed from a sheet of foldable material such as corrugated paperboard or the like and is generally rectangular in shape. Second alternative blank B2' is divided by fold lines, score lines and slits to define panels which are foldable relative to one another (as described in greater detail herein) to form the lid portion 130 of the container 101.

Second alternative blank B2' is divided into a topwall panel 141 and first and second endwall panels 142, 143 by a pair of transverse foldlines 131, 132 (shown in phantom lines), which are shown to be generally parallel to one another, although transverse foldlines 131, 132 may be oriented at some angle relative to one another. V-shaped cutouts 131*a*, 131*b*, 132*a*, 132*b* are cut into the second alternative blank B2' at opposite ends of the foldlines 131, 132, respectively. Cutouts 131*a*, 131*b*, 132*a*, 132*b* each preferably are tapered (for reasons to be described in greater detail below), but may take on any shape that might facilitate the purposes therefor.

Second alternative blank B2' further includes a pair of longitudinal foldlines 133, 134 (shown in phantom lines), which are shown to be generally parallel to one another and perpendicular to transverse foldlines 131, 132, although longitudinal foldlines 133, 134 may be oriented at some angle relative to one another or relative to transverse foldlines 131, 132.

Longitudinal foldlines 133, 134 divide topwall panel 141 into a center section 141*a* and flanking topwall flaps 141*b*, 141*c* that are foldable relative to the topwall center section 141*a* along longitudinal foldlines 133, 134, respectively. Similarly, longitudinal foldlines 133, 134 divide first and second endwall panels 142, 143 into respective center sections 142*a*, 143*a*, first endwall flaps 142*b*, 143*b* and second endwall flaps 142*c*, 143*c*, all of which are foldable relative to their respective endwall panels 142, 143 along longitudinal foldlines 133, 134, respectively.

A tearstrip 145 is embedded in the second alternative blank B2' or affixed to one surface thereof using conventional forming and attaching techniques. Tearstrip 145 preferably extends the entire length of the second alternative blank B2' parallel to foldlines 133, 134 spaced therefrom, although tearstrip 145 may extend only partially along the length of the second alternative blank B2' and may be positioned axially at any location therealong. Pull tabs 146*a*, 146*b* may be formed in one or both of the side edges of the second alternative blank B2' near terminal ends of the tearstrip 145 so as to permit gripping of at least one of the pull tabs 146*a*, 146*b* by a user and tearing of the tearstrip 145 utilizing conventional opening techniques. Tearstrip 145 preferably is provided spaced (either equally or unequally) between foldlines 133, 134.

Figure 16:
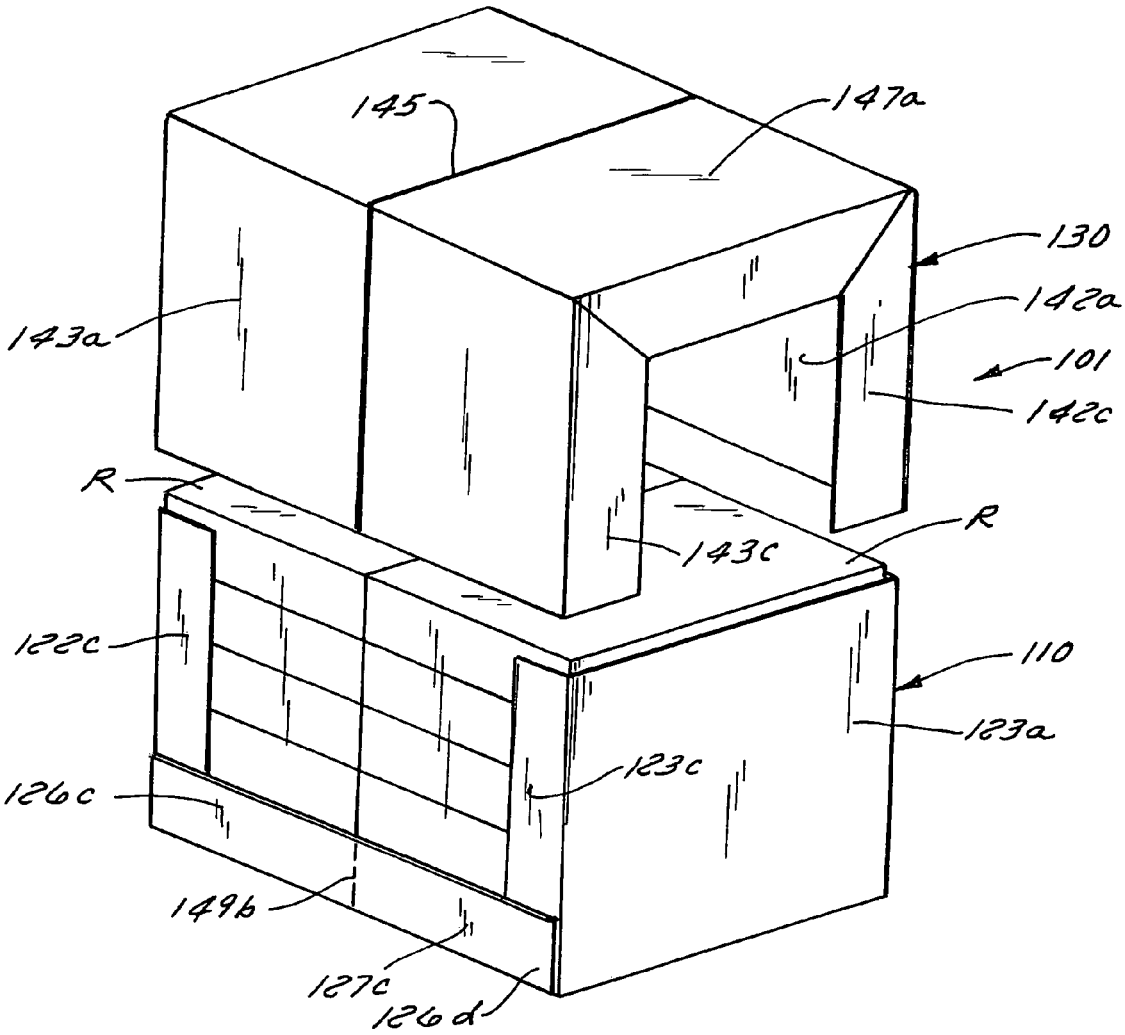
FIG. 16 is an exploded perspective view of the first blank of FIG. 14, shown folded to form a base portion of a container according to one alternative embodiment of the present invention, and of the second blank of FIG. 15, shown folded to form a lid portion of a container according to one alternative embodiment of the present invention, wherein the base portion is shown filled with a plurality of items, and wherein the lid portion is shown in spaced relation to the base portion.

With reference to FIG. 16, a plurality of items R, such as pre-wrapped reams of cut-sized paper are arranged in two (2) vertical stacks of five (5) reams, wherein the stacks are oriented in a side-by-side relationship. First and second alternative blanks B1', B2' are sized such that, when folded as described herein, base portion 110 and lid portion 130 of the container 101 tightly surround and contain the stacks, in a manner similar to the manner in which the base portion 10 and lid portion 30 of the container 1 according to the embodiment shown in FIGS. 1-13 cooperate to surround one or more stacks of items R.

More specifically, base portion 110 is formed by first folding sidewall panels 122, 123 upward relative to the basewall 121 along transverse foldlines 111, 112, respectively, such that sidewall panels 122, 123 are generally perpendicular to the basewall 121. Thereafter, sidewall flaps 122*b*, 122*c* and sidewall flaps 123*b*, 123*c* each are folded inwardly towards one another relative to sidewall panels 122*a*, 123*a*, respectively, about longitudinal foldlines 113, 114, respectively, to form vertically-oriented base portion corners of the container 101. Basewall flaps 121*b*, 121*c*, then, are folded upwardly relative to the basewall center section 121*a* along longitudinal foldlines 113, 114, respectively, and over sidewall flaps 122*b*, 123*b* and 122*c*, 123*c*, respectively, such that crushed regions 126*a*, 126*b*, 126*c*, 126*d* lie over and are adhesively secured to crushed regions 125*a*, 125*b*, 125*c*, 125*d*, respectively. Although it is preferable to adhesively secure crushed regions, alternative means of affixing the crushed regions as described herein, such as by staples, and the like, may be employed.

Lid portion 130 is formed by first folding endwall panels 142*a*, 143*a* downward relative to the topwall 141 along transverse foldlines 131, 132, respectively, such that endwall panels 142, 143 are generally perpendicular to the topwall 141. Thereafter, endwall flaps 142*b*, 142*c* and endwall flaps 143*b*, 143*c* each are folded inwardly towards one another relative to endwall panels 142*a*, 143*a*, respectively, about longitudinal foldlines 133, 134, respectively, to form vertically-oriented lid portion corners of the container 101 which lie outside base portion corners when the lid portion 130 is positioned thereover. Topwall flaps 141*b*, 141*c*, then, are folded downwardly relative to the topwall center section 141*a* along longitudinal foldlines 133, 134, respectively. V-shaped cutouts 131*a*, 131*b*, 132*a*, 132*b* permit topwall flaps 141*b*, 141*c* to lie generally in the same plane as endwall flaps 142*b*, 143*b* and endwall flaps 142*c*, 143*c*, respectively, without overlapping.

Lid portion 130 is telescopingly fit over the base portion 110 to define a fully-enclosed container 101. Tearstrip 145 is positioned preferably to be adjacent one or more of the perforation lines 149*a*, 149*b*, for the purpose and function described in greater detail below. Lid portion flaps 141*b*, 142*b*, 43*b* and flaps 141*c*, 142*c*, 143*c* are adhesively affixed to the sidewall panels 122*a*, 123*a*, respectively, so that the lid portion 130 is adhesively affixed to the base portion 110 with sufficient adhesive strength to prevent disassociation of the lid portion 130 from the base portion 110. Outwardly facing surfaces of the base portion flaps 121*b*, 122*b*, 123*b* and flaps 121*c*, 122*c*, 123*c* may also be adhesively affixed to inwardly facing surfaces of the lid portion endwall panels 142*a*, 143*a*, respectively, to further strengthen the adhesive bond between the lid portion 130 and the base portion 110, thereby forming a fully-enclosed container having sufficient rigidity to resist compression due to vertical stacking of several containers 101 on top of one another. It will be apparent to those of ordinary skill in the art upon reading the within disclosure that a container 101 according to one embodiment of the present invention meets each of the objectives thereof.

It will be apparent to those of ordinary skill in the art that a container 101 according to the present embodiment of the present invention allows for a separation thereof along its centerline, which is situated generally along the part line between individual stacks of items R. Perforations 149*a*, 149*b* permit the separation of the base portion 110 in alignment with the tearstrip 145 and the scoreline 148. The container 101, then, may be "opened" to expose the long edges of the items, for point-of-sale display purposes.

With reference now to FIG. 17, a second alternative blank B2" is shown for forming a lid portion of a container, such as the container shown in FIG. 16, where two (2) parallel tearstrips 245*a*, 245*b* are provided generally centered along the length of the blank B2". In all other regards, second alternative blank B2" is identical to alternative blank B2' (FIG. 15); however, multiple tearstrips 245*a*, 245*b* define a strip 260 of removable material, which can be removed to permit items (FIG. 16) to extend a preselected distance from within the container 101 when "opened", as described with reference to the container 101. Such an arrangement (wherein individual items extend at least partways "out" of the container) facilitates ease of removal of the items from the container, such as at the point of purchase.

Figure 18:
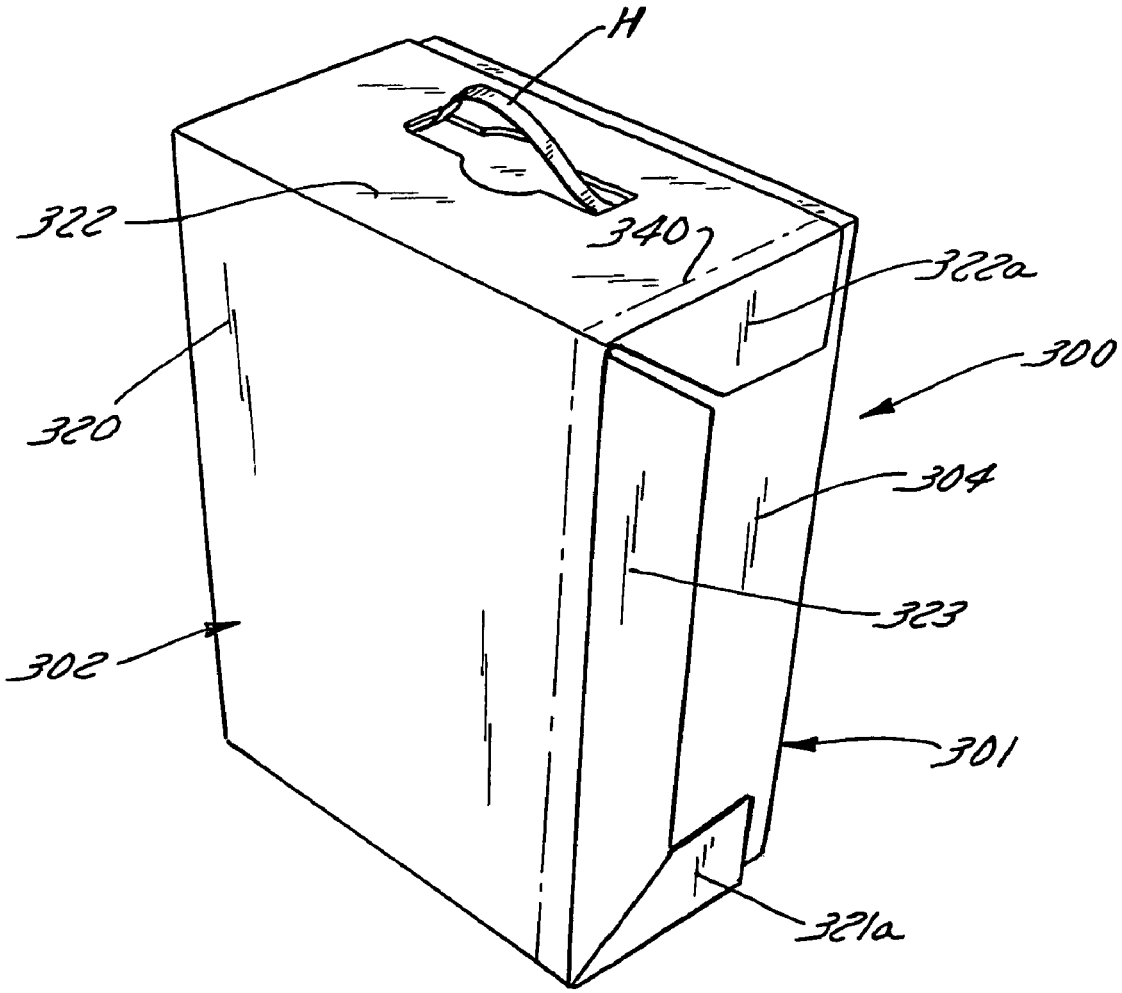
FIG. 18 is a top perspective view of a reduced sized container with a carry handle according to an alternative embodiment of the present invention.

With reference to FIG. 18, a first embodiment of a container 300 according to a second aspect of the present invention is shown, wherein the container 300 is sized to hold fewer reams of paper than a conventional ten-ream container (as shown with respect to the embodiments described above) and is lighter and easier to handle. In the particular embodiment shown in FIG. 18, the container 300 holds six reams of paper that could be placed in two stacks each of three reams tall, oriented in a transverse direction and arranged side-by-side with a parting line between the stacks disposed as represented schematically in broken lines at PL in FIG. 22.

A carry handle H is provided on the container 300 to further facilitate handling. As in the previously-described forms of the invention, the container 300 comprises a base portion 301 and a lid portion 302 wrapped around the reams of paper and secured to one another where portions of the base portion 301 and lid portion 302 overlap.

Figure 22:
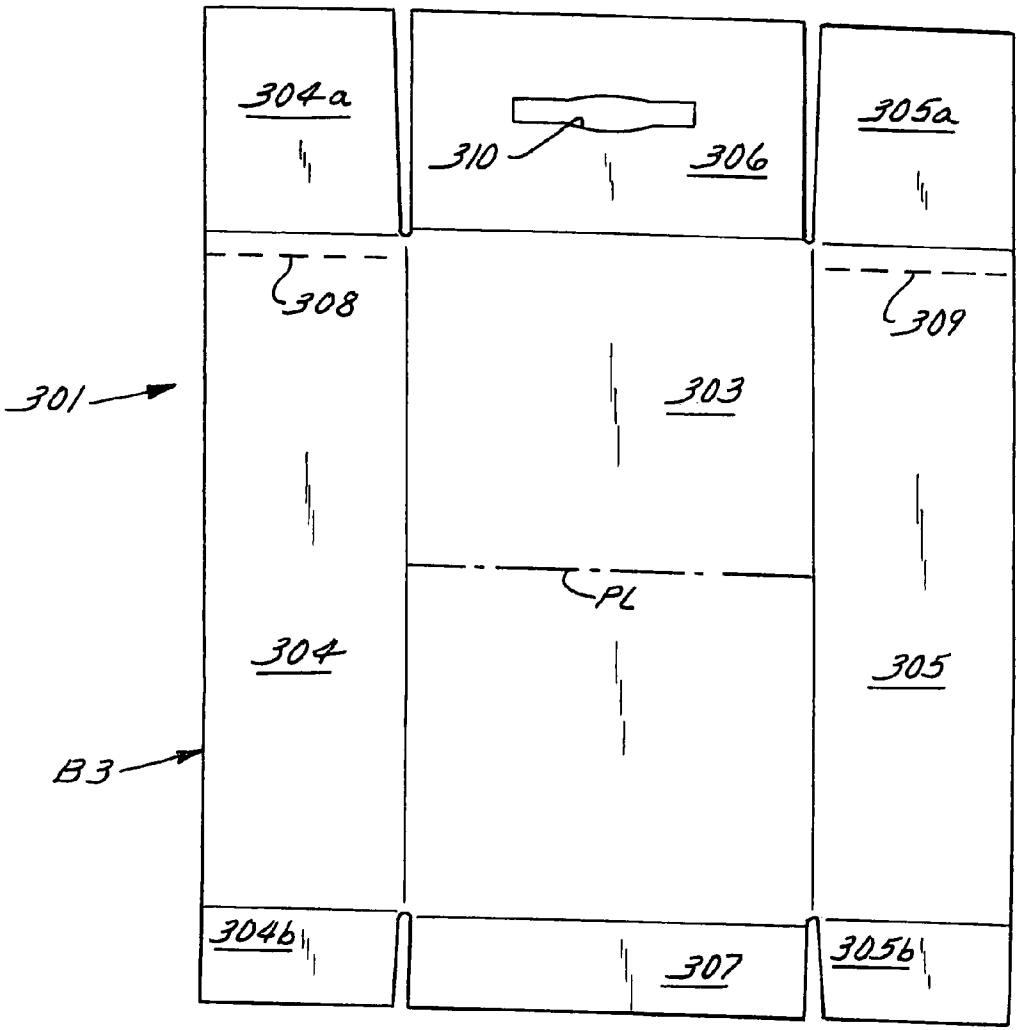
FIG. 22 is a plan view of a blank for forming a base portion of the container shown in FIG. 18.

A blank B3 for making the base portion 301 of the container 300 is shown in FIG. 22. The blank B3 has an elongate central basewall panel 303 flanked by opposite sidewall panels 304, 305 and opposite basewall flaps 306, 307. Sidewall flaps 304*a*, 304*b* are foldably joined to opposite ends of sidewall panel 304 and sidewall flaps 305*a*, 305*b* are foldably joined to opposite ends of sidewall panel 305. Lines of perforation 308, 309 extend across the ends of sidewall panels 304, 305 near the folded connections with their respective sidewall flaps 304*a*, 304*b* and 305*a*, 305*b*, respectively. Basewall flap 306 and sidewall flaps 304*a*, 305*a* are wider than the respective basewall flap 307 and sidewall flaps 304*b*, 305*b*, and a shaped opening 310 is formed through the center of basewall flap 306 for the purpose described in greater detail below.

Figure 23:
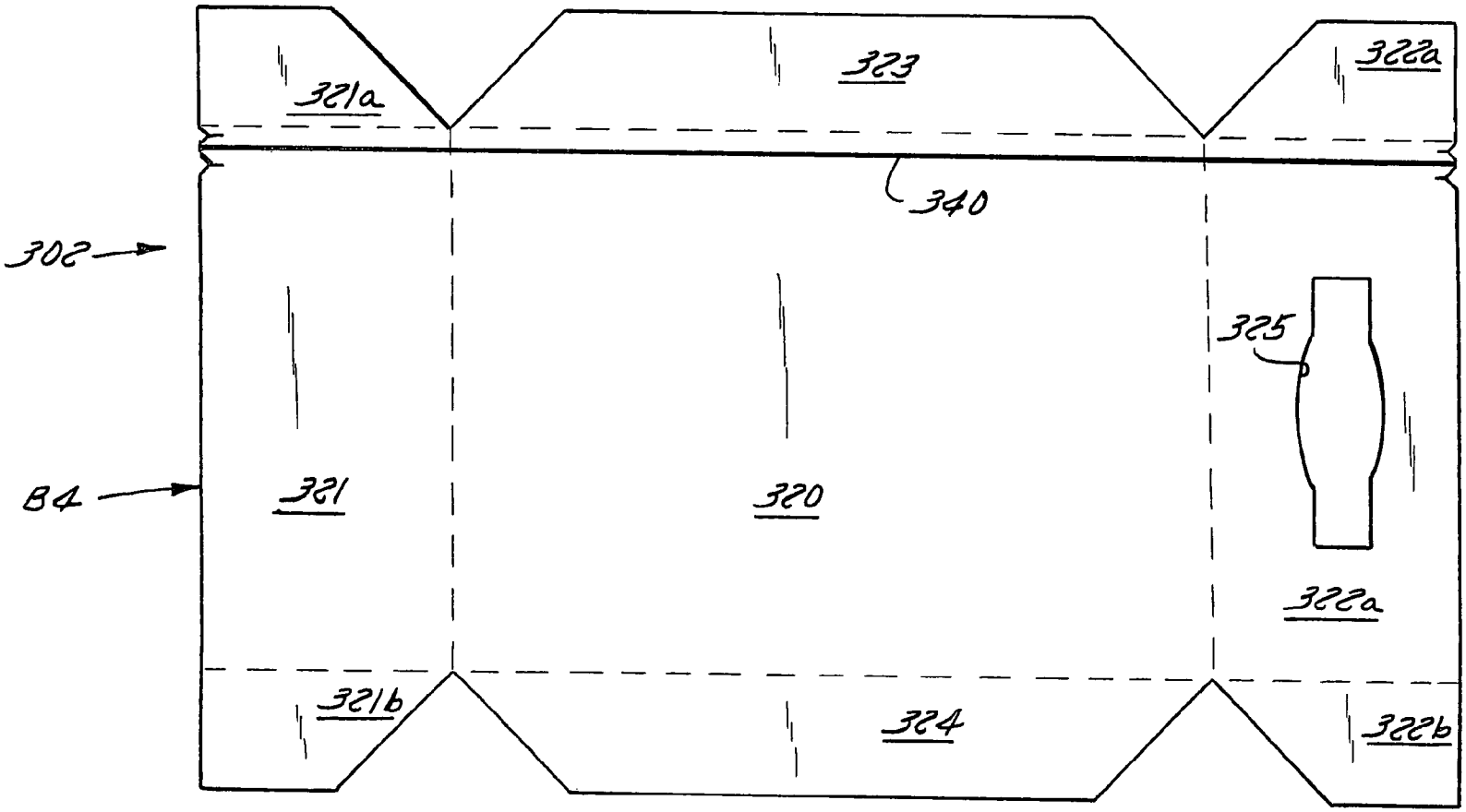
FIG. 23 is a plan view of a blank for forming a lid portion of the container shown in FIG. 18.

A blank B4 for making the lid portion 302 of the container 200 is shown in FIG. 23. The blank B4 includes an elongate central topwall panel 320 flanked on its opposite ends by endwall panels 321, 322 and on its opposite sides by topwall flaps 323, 324. Endwall flaps 321*a*, 321*b* are foldably joined to opposite sides of endwall panel 321 and endwall flaps 322*a*, 322*b* are foldably joined to opposite sides of endwall panel 322. A shaped opening 325 is formed through the center of one endwall panel 322 for the purpose described in greater detail below. It will be noted by one of ordinary skill in the art that the opening 325 is slightly larger than the opening 310 in the base portion 301 of the container 300.

The base portion 301 and the lid portion 302 are assembled about one or more reams of paper according to a process that is essentially the same as described above with respect to other embodiments of the present invention. Particularly, endwall panels 321, 322 of the lid portion 302 being positioned to overlap respective endwall panels 307, 306 of the base portion 301 and to be secured thereto, such as through the use of an adhesive. Similarly, sidewall panels 323, 324 and endwall flaps 321*a*, 321*b* and 322*a*, 322*b* of the lid portion 302 are positioned to overlap respective sidewall panels 304, 304 of the base portion 301 and to be secured thereto, such as through the use of an adhesive. It will be noted that the openings 310, 325 are in aligned registry with one another when the panels 306, 322 are in overlapping relation to one another.

Figure 24:
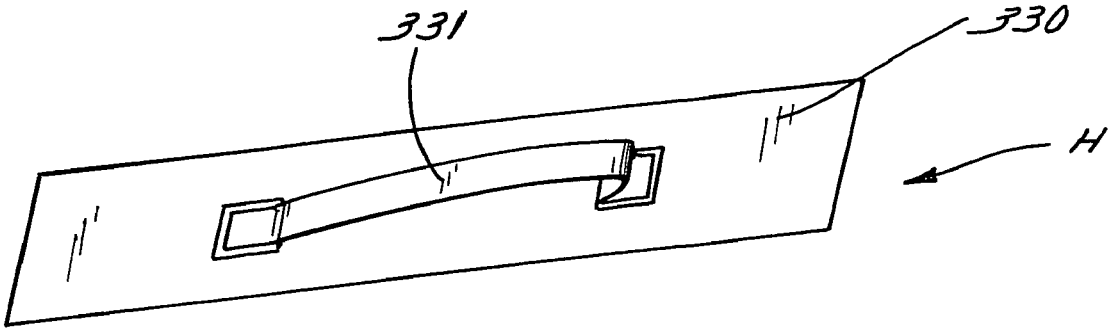
FIG. 24 is a top perspective view of a handle assembly for use in connection with a container according to any embodiment of the present invention.

The handle H, as can be seen best in FIG. 24, comprises a rectangular base plate 330 and a strap 331 attached thereto. The strap 331 preferably is flexible. The handle H is affixed to the container 300 by inserting the strap 331 through the aligned openings 310, 325 of the base and lid portions 301, 302, respectively, and thereafter attaching the base plate 330 to an inner surface of the panel 306. In this regard, it will be noted that in the particular example shown, the sidewall flaps 304*a*, 305*a* each extends approximately half-way across the width of the basewall flap 306 when the base portion 301 is erected. Accordingly, when the container 300 is fully assembled, the base plate 330 is sandwiched between the sidewall flaps 304*a*, 305*a* and the basewall flap 306. The triple-thickness provided by the overlapped corrugated panels 306, 322, 304*a*, 305*a* provides a very strong structure for the handle, enabling it to support heavy loads, including the weight of the container 300 with six or more wrapped reams of paper therein, without tearing loose from the container 300.

A tear strip 340 is formed in the lid portion 302, extending though the field of panels 320, 321, 322 near the folded connections with their respective topwall and endwall flaps, and in the erected container, the tear strip 340 and lines of perforation 308, 309 in the sidewall flaps 304, 305 of the base portion 301 are in continuous, aligned relationship with one another. This facilitates separation of a portion of the lid portion 302 and base portion 301 from the remainder of the container 300 for the purpose of exposing items contained therein. Although not shown, the lines of perforation 308, 309 can be extended to encircle the container 300 to permit complete removal of the severed portion of the container 300, if desired.

Figure 19:
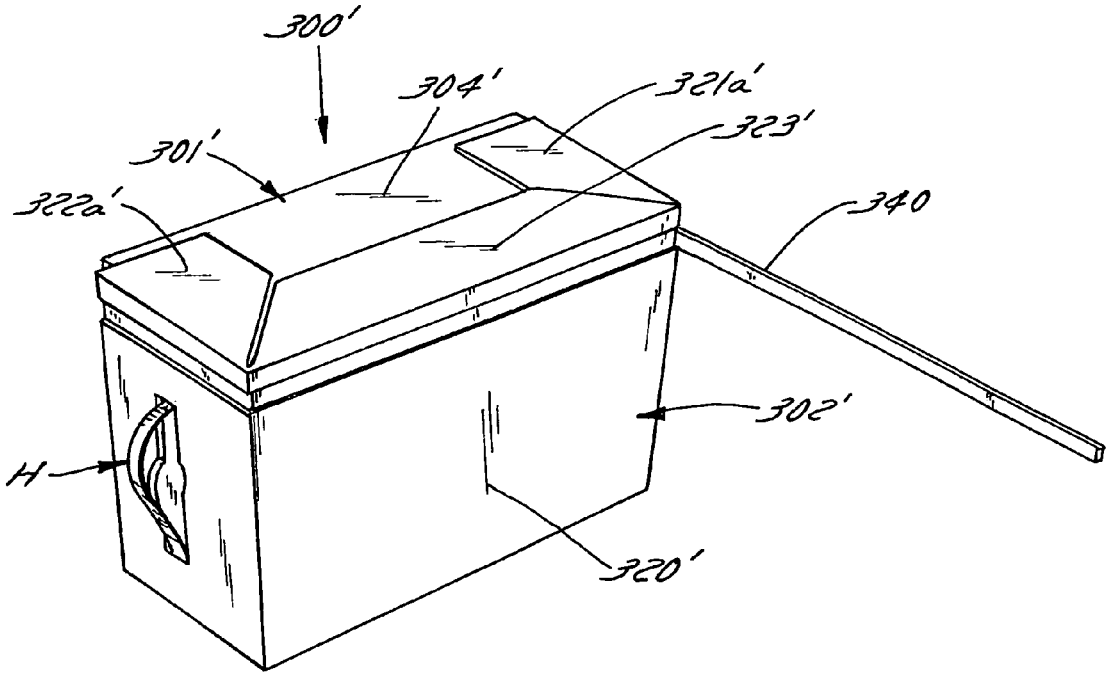
FIG. 19 is a top perspective view of the container of FIG. 18, wherein the container is shown lying on its side or base and wherein a tear strip is shown partially removed to separate one side of the container from the remainder thereof to expose reams of paper contained therein.
Figure 20:
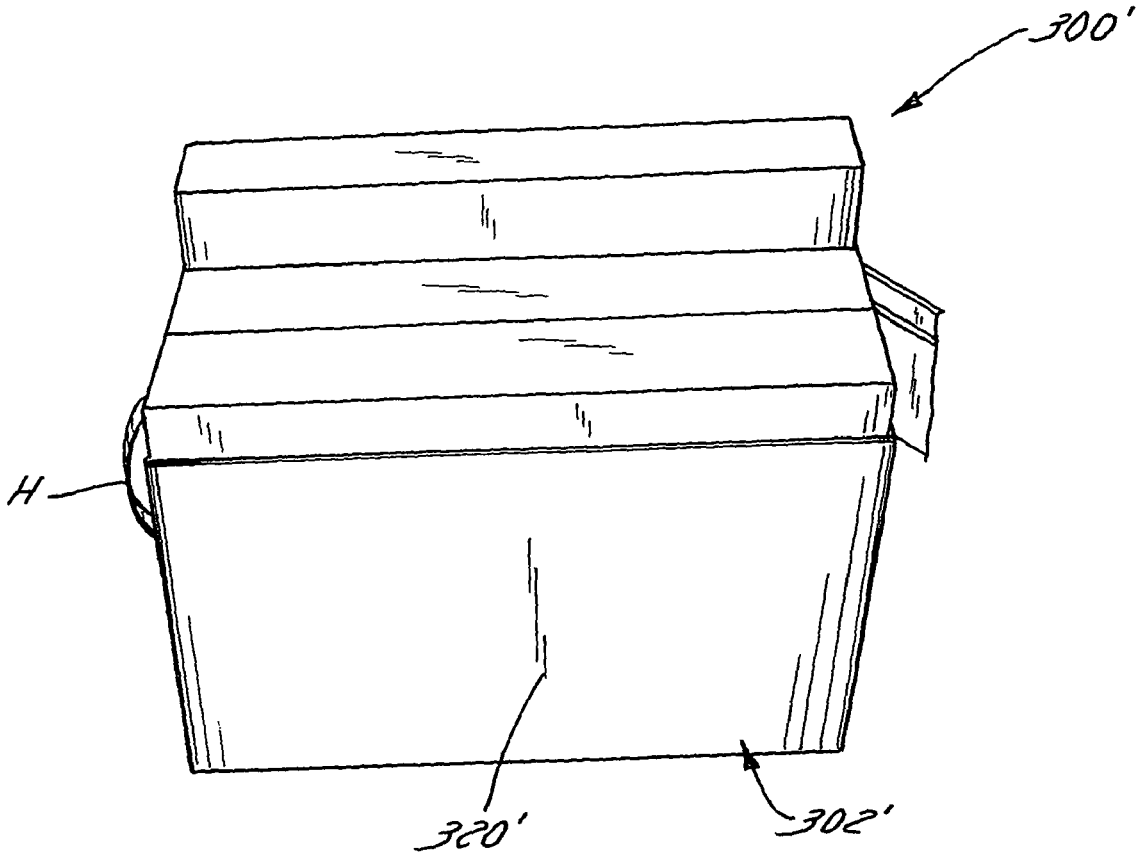
FIG. 20 is a top perspective view of the container of FIG. 19, wherein a side of the container is shown fully removed therefrom, further exposing the reams of paper contained therein.

A container 300' similar to the container 300 shown in FIGS. 18, 22 and 23 is shown in FIGS. 19 and 20, and like or corresponding parts are indicated my like reference characters primed. The container 300' shown in FIGS. 19 and 20 differs from the container 300 shown in FIGS. 18, 22 and 23 in that the container 300' shown in FIGS. 19 and 20 is designed to hold a fewer number of wrapped reams of paper, for example, between three and five reams of paper. The container 300' is shown positioned on its side with the tear strip 340 oriented upwardly, and in FIG. 19, the tear strip 340 is shown being pulled to sever a portion of the container 300' to further expose its contents. FIG. 20 shows the container 300' with the severed portion of the container 300' removed completely therefrom such that portions of the items contained therein are exposed.

Figures 21A, 21B, 21C:
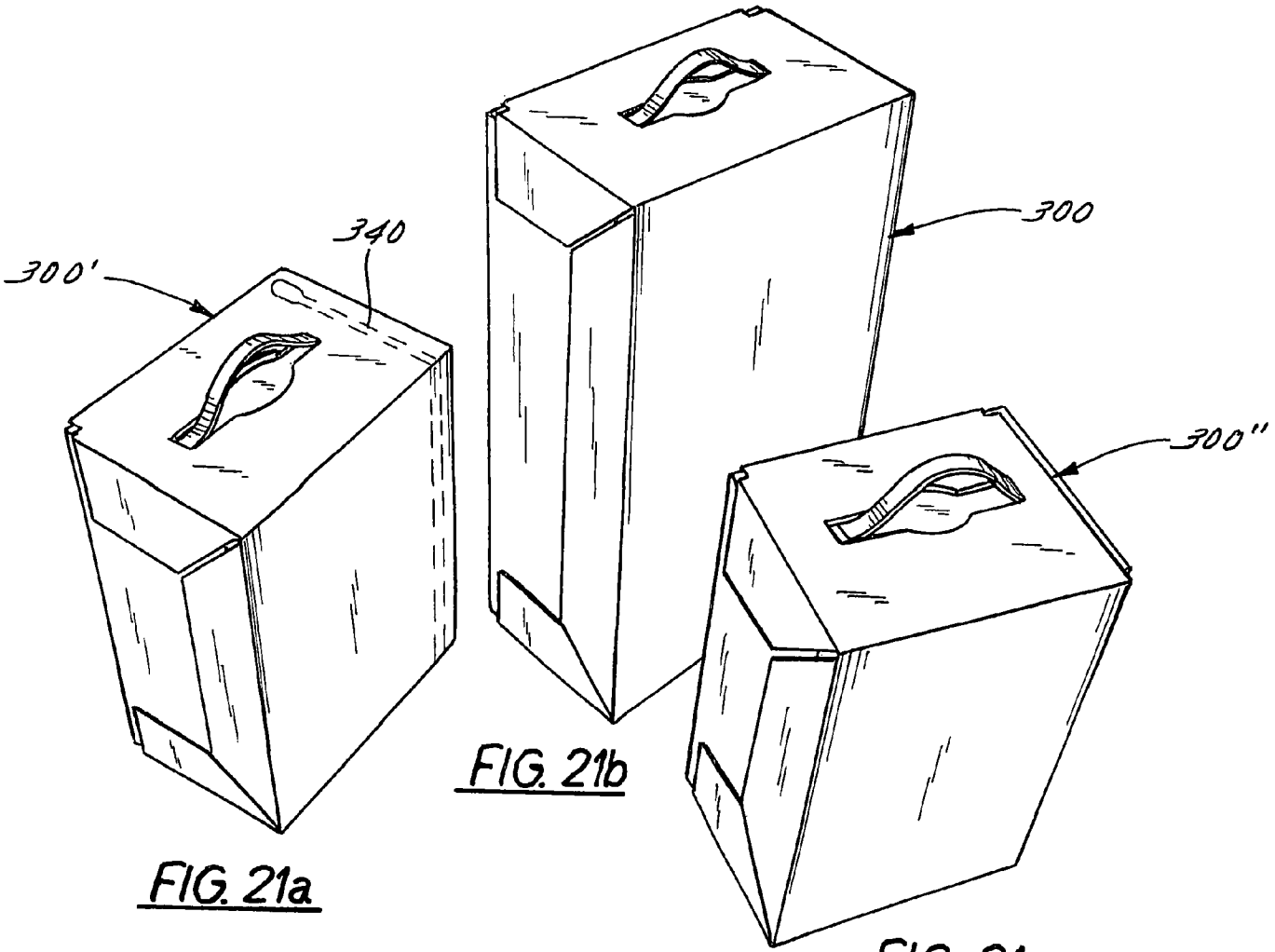
FIG. 21*a* is a top perspective view of one alternative embodiment of the present invention.
FIG. 21*b* is a top perspective view of another alternative embodiment of the present invention.
FIG. 21*c* is a top perspective view of yet another alternative embodiment of the present invention.

Examples of three different containers 300, 300', 300" are shown in FIGS. 21*a*, 21*b* and 21*c*, respectively. Containers 300, 300' are described above. Container 300" differs from container 300' in that the zipper-type tear strip 340 shown in FIG. 21*a* is replaced with a strip of sesame tape, or with a synthetic tear strip, or the like (now shown). The specific type of tear strip is not important and any type or combination thereof may be used without departing from either the spirit or the scope of the present invention.

The containers 300, 300', 300" shown in FIGS. 18-23 preferably are constructed from corrugated paperboard, cardboard, or the like, and the handle H is constructed preferably from reinforced paper, for example, the product sold by Roberts Polypro of Charlotte, N.C., under the name PH8.5X. Other materials may be used to construct either the containers or the handles used therein, for example, a plastic or polymer material may be used to construct the handle, without departing from either the spirit or the scope of the present invention.

Figure 25:
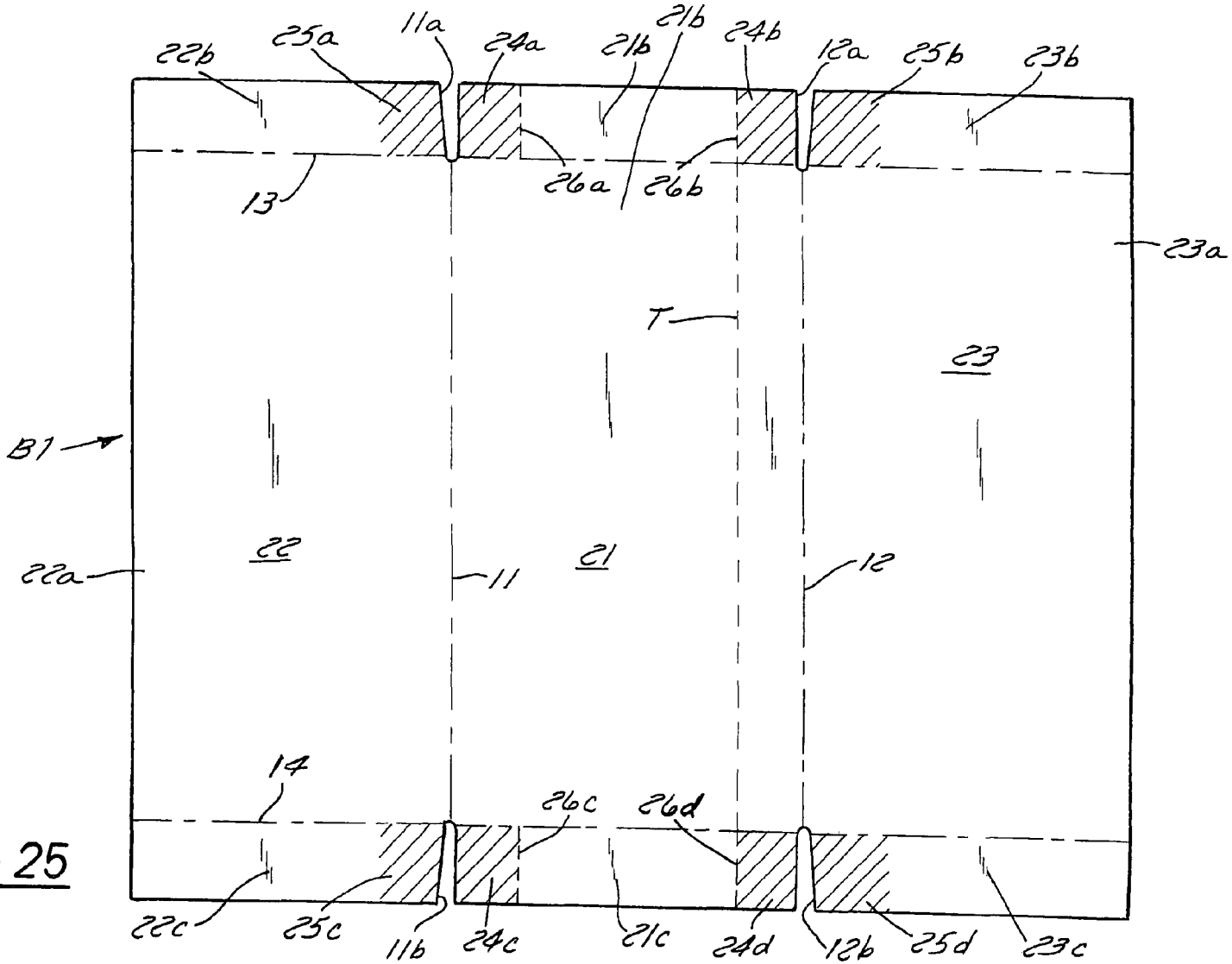
FIG. 25 is a plan view of the blank shown in FIG. 1, wherein a strip of tear tape is shown extending across at least a portion of a center section thereof.

With reference to FIG. 25, the first blank B1 used to form base portion 10 of the container 1 according to the embodiment of the present invention shown in FIG. 1 is shown further comprising a strip of tear tape T extending across basewall panel 21 spaced between (and running generally parallel to) longitudinal foldlines 13, 14. Tear tape T is positioned relative to basewall panel 21 such that tear tape T is aligned with tearstrip 45 of the lid portion 30 (FIG. 2) when the lid portion 30 is telescopingly fit over the base portion 20, as described in greater detail above. Tear tape T may be affixed to or embedded in blank B1 according to any conventional technique. For example, tear tape T may be a strip of sesame tape positioned within the corrugated structure of a conventional corrugated board. Alternatively, tear tape T may be adhered to one exterior surface of the blank B1 in a fashion that permits tearing of the blank B1 as the tear tape T is pulled from the blank B1, as described in greater detail above and as is known to those of ordinary skill in the art.

The purpose of the tear tape T is to permit complete removal of one wall of the container 10 with the tear tape T and tearstrip 45, in a manner similar to that described above with reference to the embodiment of the present invention shown in FIG. 20. Pull tabs (not shown) may be provided at either end of the tear tape T, such as are provided in the embodiments shown in FIGS. 15, 17, 23, and elsewhere, to permit easy gripping of the tear tape T for purpose of tearing through the material used to construct the base portion 20.

Because the tear tape T of the base portion 20 is separate from the tearstrip 45 of the lid portion 30, the user can decide whether to completely separate one wall from the container (such as by tearing out both the tear tape T and the tearstrip 45) or to tear out only the tear tape T or the tearstrip 45, in which case, the wall is not completely separated from the container, but instead, remains hingedly affixed thereto.

Figure 26:
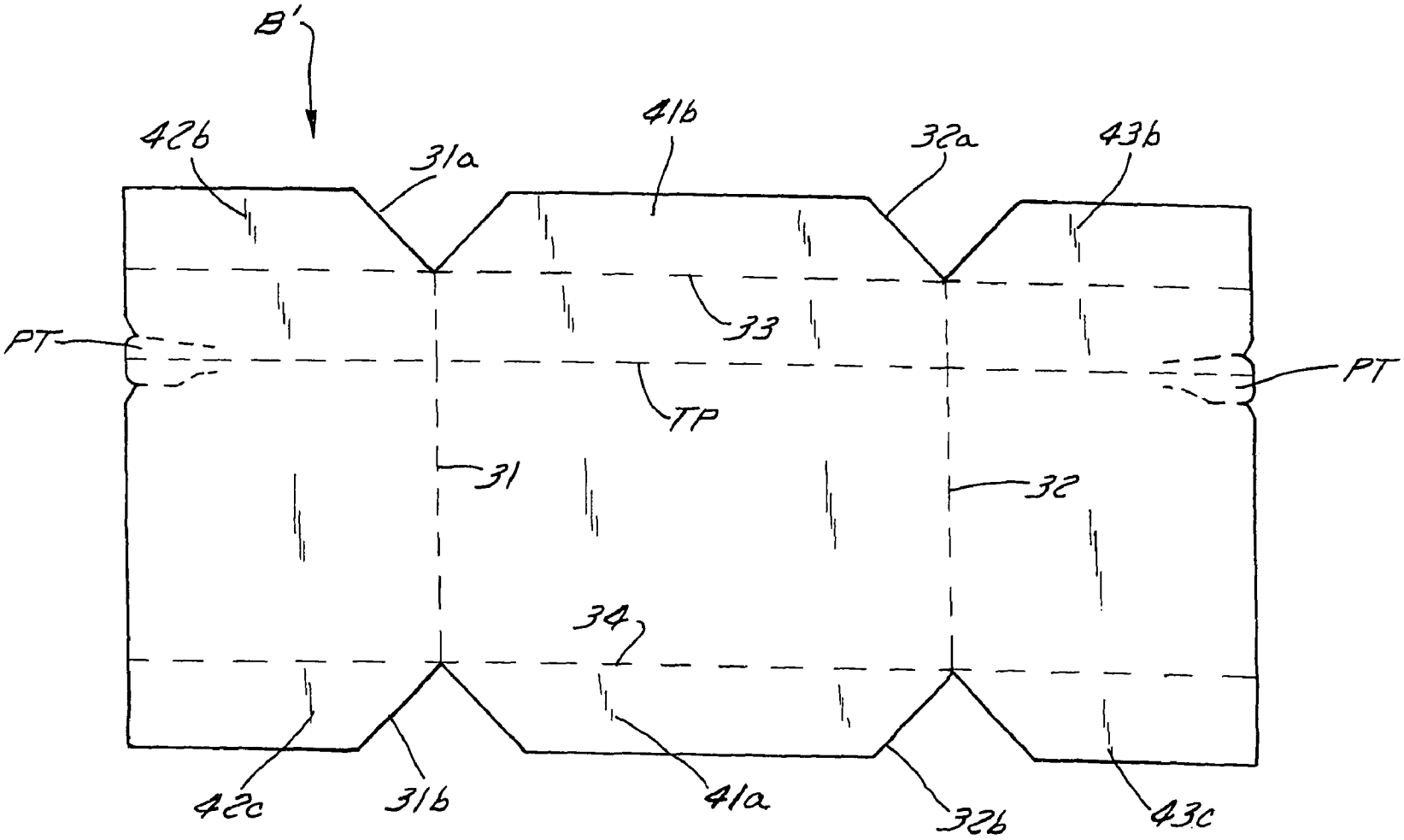
FIG. 26 is a plan view of a blank used to form either a lid portion or a base portion of a container according to yet another alternative embodiment of the present invention.
Figure 27:
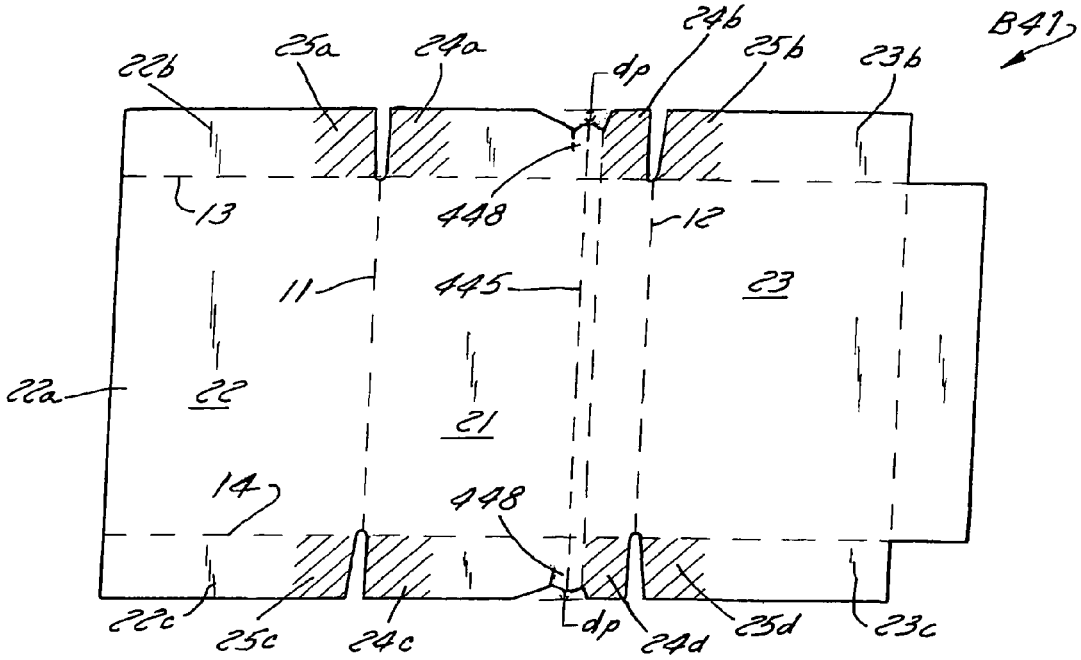
FIG. 27 is a plan view of a blank used to form a base portion of a container according to still another alternative embodiment of the present invention.

FIG. 26 further shows a further embodiment of the present invention wherein pull tabs PT are integrally-formed within blank B', which can be used to form any of the components shown in any of the embodiments of the present invention described herein. For the purpose of illustration, FIG. 27 shows blank B' having a configuration adapted to be used as a lid portion of any of the containers described herein. Pull tabs PT are provided on either end of tear tape TP, which is used to tear through the blank B' for the purpose described herein.

Figure 28:
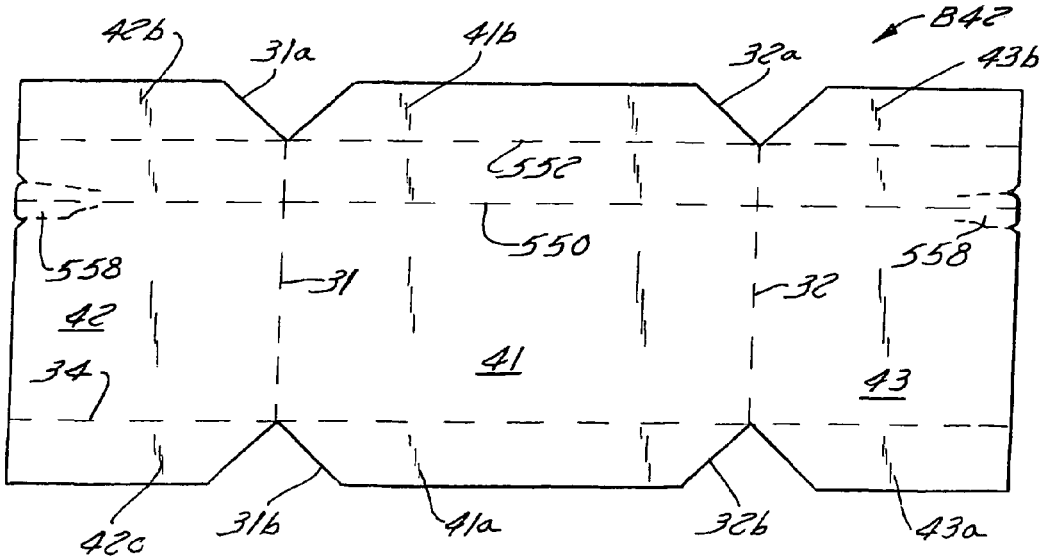
FIG. 28 is a plan view of a blank used to form a lid portion of a container according to an embodiment of the present invention for which the base portion of FIG. 27 is used.

Referring now to FIGS. 27 and 28, a container according to still yet another embodiment of the present invention is formed from a first blank B41 and a second blank B42. More particularly, first blank B41 and second blank B42 each preferably are formed from a foldable material, such as corrugated paperboard, and include a plurality of score lines, perforation lines, cuts, slots and fold lines to define a base portion and a lid portion, respectively, of a container according to the present embodiment of the present invention.

Referring specifically to FIG. 27, blank B41 is sized, shaped and configured to resemble blanks described in connection with alternate embodiments hereof, for example, to provide base portions shown in FIGS. 1, 14, 22 and 25. Blank B41 differs from the base portion blanks described in connection with alternate embodiments herein described in that blank B41 includes a strip of tear tape 445 with pull tabs 448 near or at either end thereof, wherein pull tabs 445 are spaced inwardly towards a central region of the tear tape 445 by a distance dp.

Referring now also to FIG. 28, blank B42 is sized, shaped and configured to resemble blanks described in connection with alternate embodiments hereof, for example, to provide lid portions shown in FIGS. 2, 15, 17, 23 and 26. Blank B42 differs from the lid portion blanks described in connection with alternate embodiments herein described in that blank B42 includes a strip of tear tape 550 with pull tabs 558 near or at either end thereof, wherein tear tape 550 is spaced from a foldline 552 by a distance L. As will be obvious to those of ordinary skill in the art upon reading the within description, when blanks B41, B42 are folded to define base and lid portions, respectively, and assembled to define a container similar to the container shown in FIG. 13, pull tabs 558 would lie over pull tabs 448, and "hide" pull tabs 448 from a user until lid portion tear tape 550 is used to open the container.

Figure 29:
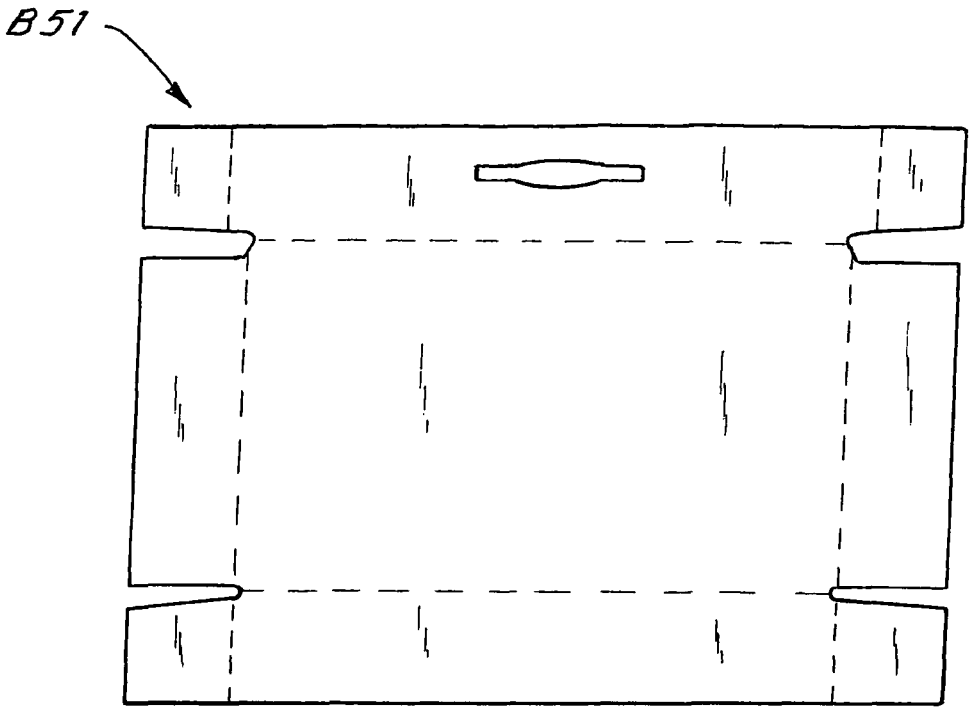
FIG. 29 is a plan view of a blank used to form a base portion of a container according to still yet another alternative embodiment of the present invention; and, FIG. 30 is a plan view of a lid portion of a container according to an embodiment of the present invention for which the base portion of FIG. 29 is used.
Figure 30:
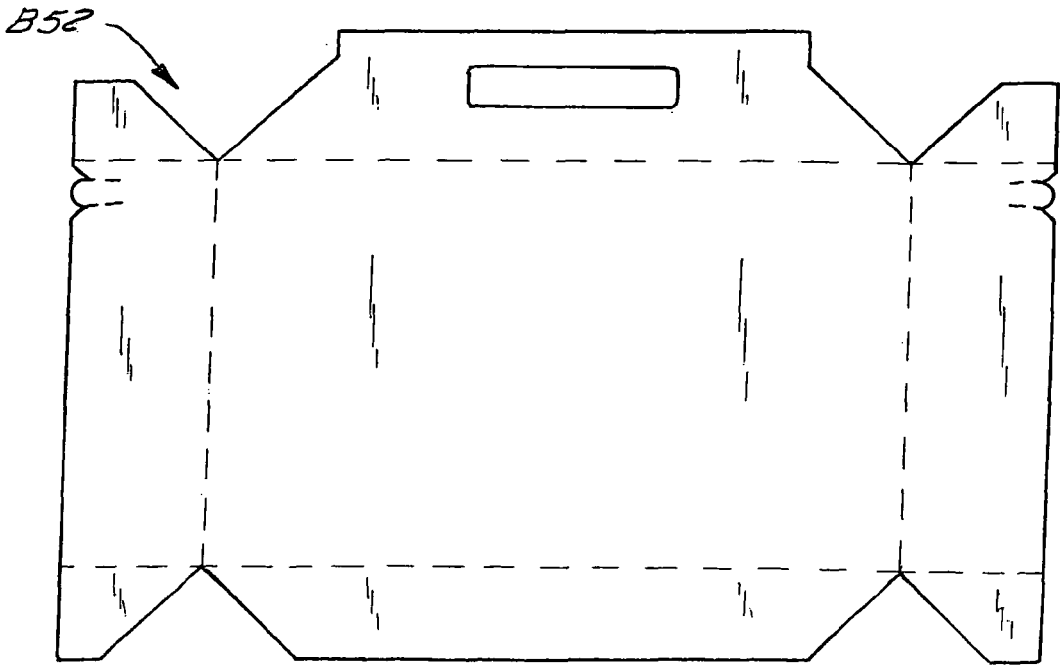

With reference to FIGS. 29 and 30, a container according to still yet another embodiment of the present invention is formed from a first blank B51 and a second blank B52. More particularly, first blank B51 and second blank B52 each preferably are formed from a foldable material, such as corrugated paperboard, and include a plurality of score lines, perforation lines, cuts, slots and fold lines to define a base portion and a lid portion, respectively, of a container according to the present embodiment of the present invention.

While the invention has been described and illustrated with reference to one or more preferred embodiments thereof, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

We claim:

1. A container for shipping items, comprising:

a base portion sized to receive a plurality of items therein, said base portion includes a base section and a pair of opposing sidewall sections wherein the base portion further includes basewall flaps having crushed regions with a thickness less than a remaining portion of the basewall flaps; and a lid portion sized to telescopically fit over said base portion, thereby enclosing said plurality of items therein, said lid portion includes a topwall section and a pair of endwall sections, wherein said base portion having at least one sidewall flap for attachment to one of said lid portion endwall sections, said lid portion having at least one endwall flap for attachment to one of said base portion sidewall sections, wherein at least a portion of either said base portion or said lid portion includes a break-away section for at least partially opening said container to permit removal of at least one of said plurality of items therefrom, said break-away section being defined by a tear strip provided in said lid portion, and further defined by one or more lines of weakness provided in said base portion and wherein said base portion includes an extension panel extending from one sidewall thereof, said extension panel being sized to permit reclosing of said container after said break-away section of said container has been at least partially detached therefrom.

2. The container of claim 1, wherein said break-away section comprises:

a lid section separable from said lid portion by said tear strip; and, a base section pivotably connected to said base portion by at least one of said lines of weakness.

3. The container of claim 2, wherein at least one of said lines of weakness in said base portion are defined by a perforation line, said perforation line being in substantial alignment with at least a portion of said tear strip.

4. The container of claim 1, wherein said tear strip is extends lengthwise at least partways through said lid portion and wherein said line of weakness is extends transversely at least partways through said base portion.

5. The container of claim 4, wherein said line of weakness in said base portion includes at least one perforation line extending at least partially therealong, and wherein said at least one perforation line is in substantial alignment with at least a portion of said tear strip.

6. The container of claim 1, wherein said break-away section is defined by a pair or tear strips.

7. The container of claim 6, wherein said pair of tear strips are parallel with one another and each extend lengthwise through at least partways through said lid portion.

8. The container of claim 1, further comprising a handle affixed to said base portion.

9. The container of claim 8, wherein said handle is affixed to an endwall section of said base portion, and wherein an enwall section of said lid portion includes an opening through which said handle is positioned.

10. The container of claim 1, wherein said base portion further comprises a tear strip, said base portion tear strip being substantially aligned with said lid portion tear strip.

11. The container of claim 10, wherein at least one end of said base portion tear strip is provided with a pull tab.

12. The container of claim 11, wherein at least one end of said lid portion tear strip is provided with a pull tab.

13. The container of claim 12, wherein said lid portion pull tab lies at least partially over said base portion pull tab.

14. The container of claim 13, wherein said base portion pull tab is concealed from view by said lid portion pull tab until said lid portion pull tab is removed therefrom.

* * * * *